US007891144B2

(12) United States Patent
Gilstrap et al.

(10) Patent No.: US 7,891,144 B2
(45) Date of Patent: Feb. 22, 2011

(54) ADJUSTABLE HEAVY GIRDER TIEDOWN

(75) Inventors: Jeremy Gilstrap, McKinney, TX (US); Jin-Jie Lin, Livermore, CA (US); Daniel M. Gray, McKinney, TX (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 3 days.

(21) Appl. No.: 10/912,260

(22) Filed: Aug. 4, 2004

(65) Prior Publication Data

US 2006/0026907 A1 Feb. 9, 2006

(51) Int. Cl.
*E04B 7/04* (2006.01)
*E04B 1/38* (2006.01)

(52) U.S. Cl. ..... 52/92.2; 52/712

(58) Field of Classification Search ..... 52/640, 52/641, 92.2, 93.2, 92.1, 92.3, 93.1, 713, 52/714, 712; 248/291.1, 324; 403/231, 403
See application file for complete search history.

(56) References Cited

U.S. PATENT DOCUMENTS

| | | | | |
|---|---|---|---|---|
| 505,154 | A | 10/1893 | Buhman | |
| 1,069,503 | A | 8/1913 | Wagner | |
| 1,170,188 | A * | 2/1916 | Rasmussen | 135/149 |
| 1,277,766 | A | 9/1918 | Stadelman | |
| 1,787,167 | A | 12/1930 | Purdy | |
| 2,369,687 | A | 2/1945 | Ralston | |
| 2,467,115 | A | 4/1949 | Duggan | |
| 2,911,690 | A | 11/1959 | Arthur | |
| 3,392,848 | A * | 7/1968 | McConnell et al. | 211/192 |
| 3,659,884 | A | 5/1972 | Ohlin | |
| 3,785,108 | A * | 1/1974 | Satchell | 52/645 |
| 3,846,944 | A * | 11/1974 | Lambert | 52/236.3 |
| 3,986,318 | A * | 10/1976 | McConnell | 403/384 |
| 4,022,537 | A | 5/1977 | Gilb et al. | |
| 4,106,257 | A * | 8/1978 | Gilb | 52/693 |
| 4,106,630 | A * | 8/1978 | Rosenband | 211/191 |
| 4,199,908 | A | 4/1980 | Teeters | |
| 4,327,532 | A | 5/1982 | Matthews | |
| 4,381,635 | A | 5/1983 | Solo | |
| 4,410,294 | A | 10/1983 | Gilb et al. | |
| 4,414,785 | A | 11/1983 | Howell | |
| 4,449,335 | A | 5/1984 | Fahey | |

(Continued)

FOREIGN PATENT DOCUMENTS

EP 0 357 273 A1 3/1990

OTHER PUBLICATIONS www.USPconnectors.com 2001 Catalog Truss and Rafter Tiedowns.*

(Continued)

*Primary Examiner*—Brian E Glessner
*Assistant Examiner*—Adriana Figueroa
(74) *Attorney, Agent, or Firm*—Charles R. Cypher; James R. Cypher

(57) ABSTRACT

An adjustable connector is provided for connecting an elongate substantially vertical supporting structural member and an elongate generally horizontal supported structural member. The connector is provided with a side attachment member that attaches to an elongate substantially vertical supporting structural member and a cap that attaches to the elongate generally horizontal supported structural member, with a pin connection that enables rotation between the cap and the side attachment member.

80 Claims, 23 Drawing Sheets

U.S. PATENT DOCUMENTS

| | | | | | |
|---|---|---|---|---|---|
| 4,527,375 | A | | 7/1985 | Braginetz | |
| 4,571,114 | A | | 2/1986 | Rionda et al. | |
| 4,572,695 | A | | 2/1986 | Gilb | |
| 4,714,372 | A | | 12/1987 | Commins | |
| 4,744,192 | A | | 5/1988 | Commins | |
| 4,802,786 | A | | 2/1989 | Yauger et al. | |
| 4,805,787 | A | * | 2/1989 | Gillotte | 211/191 |
| 4,896,985 | A | | 1/1990 | Commins | |
| 5,094,059 | A | | 3/1992 | Ganescu | |
| 5,111,632 | A | | 5/1992 | Turner | |
| 5,303,520 | A | | 4/1994 | Gozdziak | |
| 5,335,469 | A | | 8/1994 | Stuart | |
| 5,351,456 | A | * | 10/1994 | Paine, Jr. | 52/426 |
| 5,380,115 | A | | 1/1995 | Colonias | |
| 5,442,887 | A | * | 8/1995 | Welsh | 52/92.2 |
| 5,448,871 | A | | 9/1995 | Newman et al. | |
| 5,553,961 | A | | 9/1996 | Olden | |
| 5,555,694 | A | * | 9/1996 | Commins | 52/702 |
| 5,560,156 | A | | 10/1996 | McDonald | |
| 5,575,130 | A | | 11/1996 | Chiodo | |
| 5,577,860 | A | | 11/1996 | Plank | |
| 5,595,031 | A | | 1/1997 | Commins | |
| 5,640,822 | A | * | 6/1997 | Haswell | 52/712 |
| 5,718,533 | A | | 2/1998 | Mullet et al. | |
| 5,732,524 | A | | 3/1998 | Kalker et al. | |
| 5,857,295 | A | | 1/1999 | Mikawa | |
| 5,870,861 | A | | 2/1999 | Gnaedinger | |
| 6,021,839 | A | * | 2/2000 | Knezevich et al. | 160/183 |
| 6,167,675 | B1 | | 1/2001 | LeBlanc | |
| 6,219,975 | B1 | | 4/2001 | Olden | |
| 6,295,781 | B1 | | 10/2001 | Thompson | |
| 6,324,810 | B1 | | 12/2001 | Thompson | |
| 6,401,422 | B1 | * | 6/2002 | Olden | 52/645 |
| 6,490,840 | B1 | | 12/2002 | Thompson | |
| 6,510,666 | B1 | | 1/2003 | Thompson | |
| 6,513,290 | B2 | | 2/2003 | Leek | |
| 6,658,796 | B1 | | 12/2003 | Higgins | |
| 6,662,517 | B1 | | 12/2003 | Thompson | |
| 6,763,634 | B1 | | 7/2004 | Thompson | |
| 6,877,284 | B2 | | 4/2005 | Thompson | |
| 6,971,623 | B2 | | 12/2005 | Allmon et al. | |
| 7,065,932 | B2 | | 6/2006 | Roesset et al. | |
| 7,128,225 | B2 | * | 10/2006 | Saltzburg et al. | 211/187 |
| 7,254,919 | B2 | | 8/2007 | Lutz et al. | |
| 2002/0066247 | A1 | * | 6/2002 | Leek | 52/295 |
| 2004/0079034 | A1 | | 4/2004 | Leek | |
| 2004/0079044 | A1 | | 4/2004 | Troth et al. | |
| 2008/0244993 | A1 | | 10/2008 | Crumley | |

OTHER PUBLICATIONS

Hughes Manufacturing, Inc. "Uplift Strap Connectors," 1997/1998 catalog, Hughes Manufacturing, Inc. (Largo, Florida), p. 38. (1997).

Hughes Manufacturing, Inc. "Uplift Strap Connectors," 1996/1997 catalog, Hughes Manufacturing, Inc. (Largo, Florida), p. 36. (1996).

USP Structural Connectors, "Truss & Rafter Tiedowns," USP Full Line Catalog 2004, United Steel Products Company. (Livermore, California) p. 48. (2004).

USP Structural Connectors, "Embedded Truss Anchors," USP Full Line Catalog 2004, United Steel Products Company. (Livermore, California) (2004) pp. 49-53.

USP Structural Connectors, "Strap Truss Tiedowns-SGP series" USP Full Line Catalog 2004, United Steel Products Company. (Livermore, California) p. 54. (2004).

USP Structural Connectors, "Uplift Girder Ties" USP Full Line Catalog 2004, United Steel Products Company. (Livermore, California). (2004). pp. 55-57.

USP Structural Connectors, "Girder Tiedowns" USP Full Line Catalog 2004, United Steel Products Company. (Livermore, California) (2004) pp. 58-60.

USP Structural Connectors, "Masonry Uplift Connectors-SHA Series" USP Full Line Catalog 2004, United Steel Products Company. (Livermore, California) p. 61. (2004).

USP Structural Connectors, "Truss Straps" USP Full Line Catalog 2004, United Steel Products Company. (Livermore, California) p. 62. (2004).

USP Structural Connectors, "Hurricane Gusset Angles-HGA Series" USP Full Line Catalog 2004, United Steel Products Company. (Livermore, California) p. 63. (2004).

USP Structural Connectors, "Hurricane/Selsmic Anchors" USP Full Line Catalog 2004, United Steel Products Company. (Livermore, California). (2004). pp. 64-67.

Simpson Strong-Tie Connectors, "LTA1 Lateral Truss Anchor," C-2000 Catalog, Simpson Strong-Tie Company, Inc. (Pleasanton, California) p. 109 (2000).

Simpson Strong-Tie Connectors, "Heavy Girder Tiedowns," C-2000 Catalog, Simpson Strong-Tie Company, Inc. (Pleasanton, California) p. 109 (2000).

Simpson Strong-Tie Connectors, "Seismic and Hurricane Ties," C-2003 Catalog, Simpson Strong-Tie Company, Inc. (Dublin, California) p. 134 (2003).

USP Structural Connectors, "Truss & Rafter Tiedowns," USP Full Line Catalog 2003, United Steel Products Company, (Livermore, California) (2003) pp. 41-55.

Simpson Strong-Tie, LTT/MTT/HTT Tension Ties, C-2005 catalog, Simpson Strong-Tie Company, Inc. (Pleasanton, California) p. 25 (2005).

Third Party Declaration by Douglas La Chappelle dated Sep. 13, 2006.

* cited by examiner

ADJUSTABLE HEAVY GIRDER TIEDOWN

BACKGROUND OF THE INVENTION

The roof members of building structures, particularly those located in high wind areas, are often tied down to the supporting wall system to resist the uplift forces caused by winds blowing into, over, and around the structure. Conventionally, these members are tied down to the walls with simple light gauge steel brackets and/or straps which attach to the sides and tops of the roof members and the wall system. The connectors are fastened to the roof and wood wall members with nails or wood screws. The connectors are fastened to concrete or masonry walls with masonry screws, epoxied rods, or are simply embedded into the substrate during construction of the walls. Often the roof is configured such that multiple roof members are supported on one end by the wall and on the other end by a single roof member, commonly referred to as a girder. Each of the roof members which are supported by the girder carry both uplift and download forces which are transferred into the girder through mechanical connections. Often the accumulated forces transferred into the girder can be significant, so much that conventional light gauge connectors do not adequately resist the high uplift forces in the member and as such heavy duty connectors are required to be attached to these girders. Attachment of these heavy duty connectors can be challenging in areas of the country which use concrete or masonry walls because many products are installed to the top of the wall system. This poses problems particularly when products are installed after the framing is complete, which is a common occurrence. Finally, it is standard engineering practice that these high uplift forces are resisted through connector attachment to the top chord of a truss member by either fastening directly to the member or wrapping over the top of the member. Top chord pitches vary widely from job to job and can even vary on the same job in different areas of the roof. The present invention provides a significant improvement on these prior art connectors by offering a connector which can be field adjusted to meet the variable roof pitches and can attach to the face of the wall by means of masonry anchors driven into the constructed wall. The invention can be attached to the top chord through high capacity screws or the traditional method of wrapping over the truss. The present invention also provides an adjustable connector that does not have to be embedded in concrete or masonry and that has unusually strong pin connections that make it adjustable.

SUMMARY OF THE INVENTION

An object of the present invention is to provide an adjustable connector for connecting an elongate substantially vertical supporting structural member and an elongate generally horizontal supported structural member. This object is achieved by providing a connector with a side attachment member that attaches to an elongate substantially vertical supporting structural member and a cap that attaches to the elongate generally horizontal supported structural member, with a pin connection that enables rotation between the cap and the side attachment member.

An object of the present invention is to provide a pin connection that prevents inadvertent separation of the cap and the side attachment member. This object is achieved by providing a pin connection with a pin opening in either the cap or the first side attachment member, or both, and a pin that passes through the pin opening or openings, the pin having one or more restraint extensions that extend beyond the circumference of the pin opening or openings, preventing the pin from withdrawing from the pin opening or openings. In some embodiments, this is achieved by forming the restraint extensions with one or more lobes that extend beyond the body of the pin and the pin opening.

The pin is able to rotate within the pin opening or openings. If the pin is fixed to either the cap or side attachment member, the pin opening is in the other of the cap or side attachment member. The pin opening is not sealed. By contrast, a preferred method of attaching the pin is to insert its first end in a D-shaped aperture in either the cap or side attachment member. The first end of the pin is formed with a D-shaped circumference and it is welded in place in the D-shaped aperture so that it cannot rotate within the D-shaped aperture or withdraw from it, and the D-shaped aperture is sealed so that there is no visible opening.

An object of the present invention is to provide a strong pin connection. In some embodiments, this is achieved by fixedly attaching the pin to either the cap or the side attachment member. In some embodiments, this is further achieved by welding the first end of the pin to the cap. In other possible embodiments, the pin can be fixedly attached to the side attachment member. In some embodiments, the pin is not fixed to either the cap or the side attachment member, but instead passes through pin openings in both and has restraint extensions at both ends. In some embodiments, these are formed as circumferential flanges. In some embodiments, this is simply achieved by using a rivet as the pin.

An object of the present invention is to provide a pin connection that allows the cap and side attachment member to be separated. In some embodiments, this is achieved by forming the pin opening with open lobes that match the lobes on the pin, like a keyhole and key combination.

An object of the present invention is to provide a connector that resists uplift. In some embodiments, this is achieved by forming the cap with a substantially planar top attachment portion that interfaces with the supported structural member.

An object of the present invention is to provide a connector that attaches to both sides of the supported structural member. In some embodiments, this is achieved by forming the cap with a second substantially planar side attachment portion.

An object of the present invention is to provide a connector that attaches to both side of the supporting structural member. In some embodiments, this is achieved by having a second side attachment member and a second pin connection. If the cap has no substantially planar top attachment portion, a connector that has a second side attachment member and a cap with a second substantially planar side attachment portion, is the same as two connectors that each have only a first side attachment member and a cap with only a first substantially planar side attachment portion.

An object of the present invention is to provide a connector that provides rotation on an axis parallel to the supporting structural member. In some embodiments, this is achieved by forming the side attachment member with a connection portion that is attached to the edge of the substantially planar attachment portion. In some embodiments, this is further achieved by welding the connection portion to the substantially planar attachment portion.

An object of the present invention is to provide a secure connection between the connector and the supporting structural member. This is achieved by forming the side attachment member with fastener openings and passing fasteners through the openings and into the supporting structural member.

An object of the present invention is to provide a secure connection between the connector and the supporting structural members. This is achieved by forming the side attachment member with fastener opening and passing fasteners through the openings and into the supporting structural member. If the supporting structural member is made of masonry or concrete, the preferred fasteners connecting the side attachment member with are masonry anchors.

An object of the present invention is to provide a secure connection between the connector and the supported structural members. This is achieved by forming the cap with fastener opening and passing fasteners through the openings and into the supported structural member. If the cap is formed with a with a substantially planar top attachment portion and a second substantially planar side attachment portion, the preferred fasteners connecting the cap to the supported structural member are nails. If the cap is formed without a substantially planar top attachment portion, the preferred fasteners connecting the cap to the supported structural member are self-drilling wood screws.

An object of the present invention is to provide a connector that is corrosion resistant. This is achieved by forming the connector from galvanized steel and, when the connector includes welding, painting the connector.

An object of the present invention is to provide a connector that has reinforced pin openings. In some embodiments, this is achieved by creating circumferential embossments around the pin openings. A further object of the present invention is to provide pin openings that share the transfer of loads between the cap and the side attachment members with the pin. In some embodiments, this is achieved by forming the cap and side attachment members with matching embossments that fit together with matched bearing surfaces.

An object of the present invention is to provide a connector that has side attachment members that are reinforced against bending. In some embodiments, this is achieved by forming the substantially planar attachment portions with reinforcing flanges. In some embodiments, this is achieved by forming the connection portions with reinforcing flanges.

An object of the present invention is to provide a connector that has side attachment members that are simple, strong and lightweight. In some embodiments, this is achieved by forming the side attachment member by bending a V-shaped length of steel in half to form a two-ply substantially planar attachment portion and a connection portion that joins the plies at the point where the two legs of the V join.

There are two basic preferred types of the present invention. The first is formed from heavier gauge steel, includes welding, and is painted, which is a matter of course when the connector includes welded parts, since welding destroys the corrosion protection offered by galvanized steel. Preferably, the heavier gauge steel type of the present invention uses a pin that is welded to one component of the connector. The second basic type of the present invention is formed from lighter gauge steel, is not welded, and is therefore not painted either. The lighter gauge steel type preferably uses a pin component that is separate from the components that connect to the supporting structural member and the supported structural member. The light gauge steel type preferably includes features, such as additional flanges and embossments, that stiffen it and thereby provide strength similar to that of the heavier gauge steel.

Both basic preferred types of the present invention have a cap that connects to or holds the supported structural member, and two side attachment members, or straps, that are connected to the cap by pin connections and which, in turn, connect to the supporting structural member.

In the first basic preferred form of the present invention, the pin is a post that is connected to, or part of, either the cap or side attachment member. There is a matching pin opening in the opposed cap or side attachment member, through which the post passes, forming a hinge. The preferred form of this pin connection permits the cap and side members to be separated from each other.

In the second basic preferred form of the present invention, the pin is separate from the cap and side attachment members, both of which have pin openings, so that the pin passes through both the cap and the side attachment member. The ends of the pin are widened and the cap and side attachment members can not be separated.

BRIEF DESCRIPTION OF THE DRAWINGS

FIG. 24 is identical to FIG. 11 except that FIG. 24 shows a side attachment member in which the connection portion and substantially planar attachment portion are formed, rather than welded, together, as shown in FIG. 8.

FIG. 31 is identical to FIG. 8 but is represented for convenience in viewing different angles of the pin connection in the cap.

DETAILED DESCRIPTION OF THE INVENTION

Basic Connection

Figure 17:
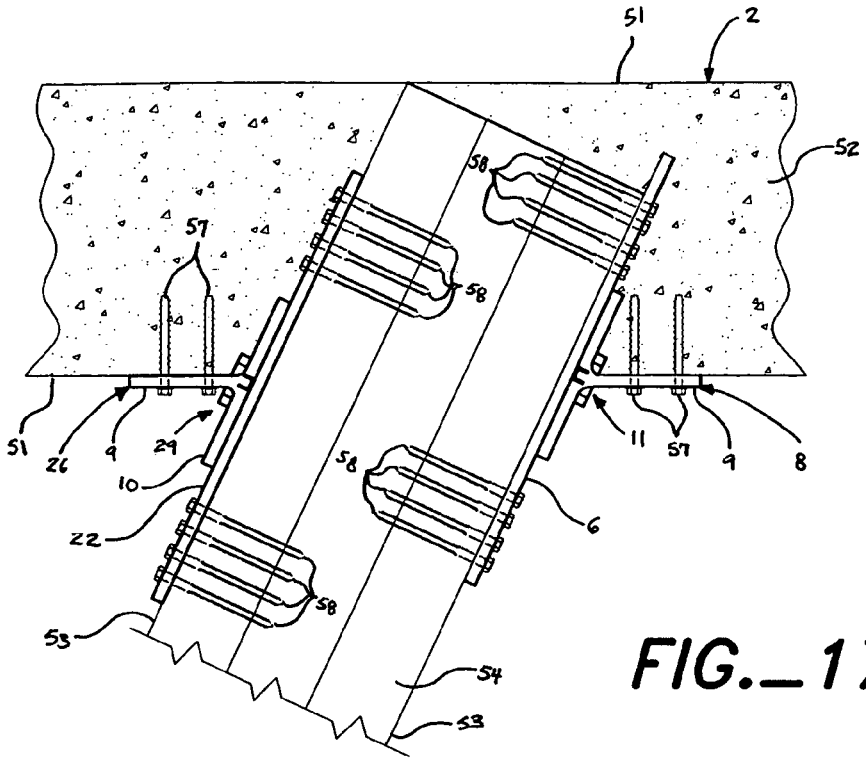
FIG. 17 is a top plan view of the connection of the present invention in which the supported structural member is not orthogonal to the supporting structural member, meeting the wall at an angle, and the two are connected by a connector with a cap that has two separate substantially planar side attachment members.
Figure 18:
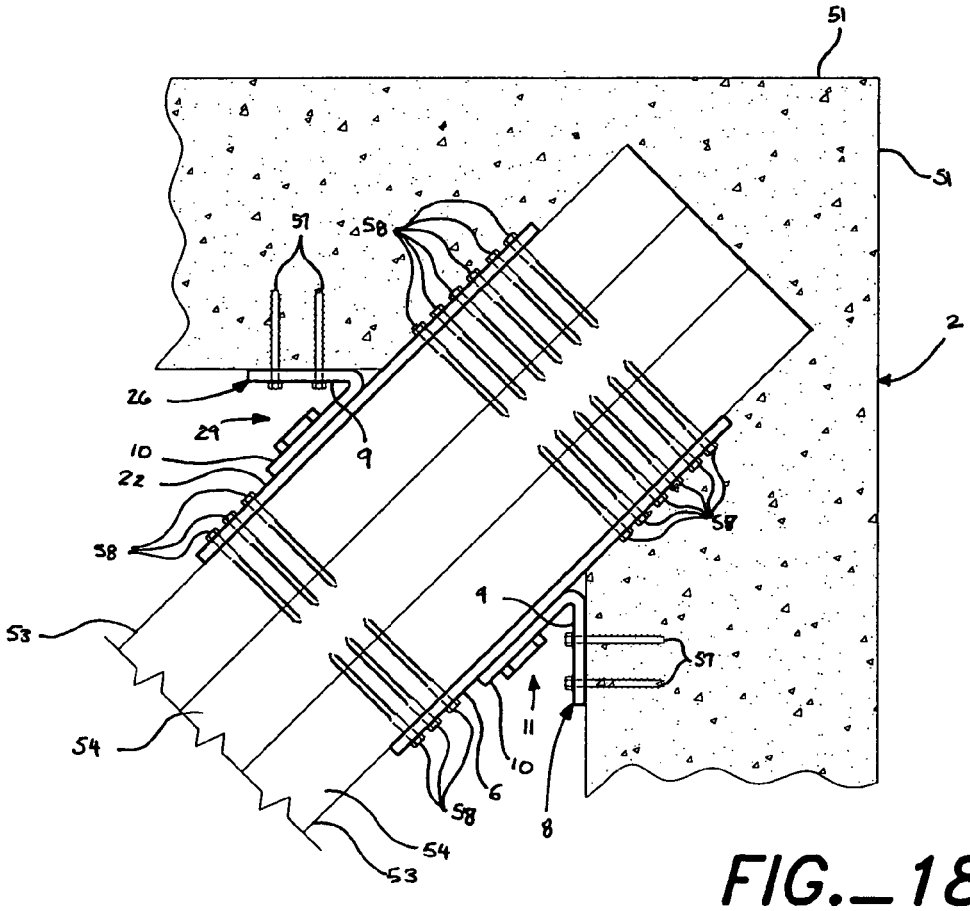
FIG. 18 is a top plan view of the connection of the present invention in which the supported structural member is not orthogonal to the supporting structural member, bisecting the corner of a wall, and the two are connected by a connector with a cap that has two separate substantially planar side attachment members.

As shown in FIGS. 1A-1D, the present invention is a connection 1 that comprises an elongate substantially vertical supporting structural member 2, further comprising two sides 51 and a top 52, supporting an elongate generally horizontal supported structural member 3, further comprising two sides 53 and a top 54, that is not parallel to the elongate substantially vertical supporting member 2, and a connector 4. In most installations, the supported structural member 3 and the supporting structural member 2 will be generally orthogonal, but as shown in FIG. 17 the supported structural member 3 may be diagonal to the supporting structural member 2. In particular, as shown in FIG. 18, trusses, the preferred form of the supported structural member 3, installed at corners run at 45 degrees to the supporting structural member 2, bisecting what is usually a 90 degree angle between two walls, the preferred form of the supporting structural member 2.

Figure 1A:
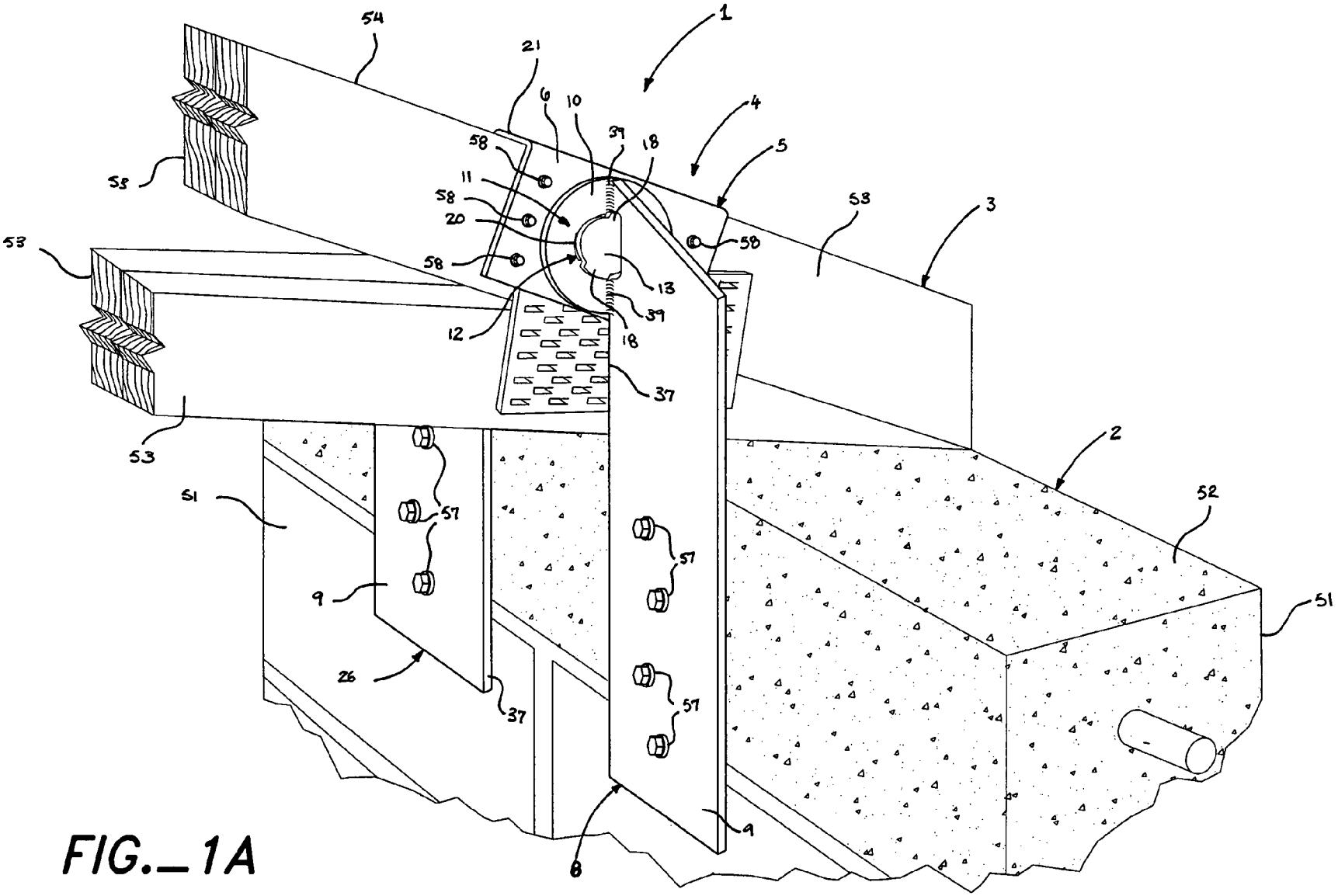
FIG. 1A is a perspective view of a concrete masonry wall, with a concrete tie beam surmounting the wall, supporting a pitched girder truss that is orthogonal to the wall and ends at the outer side of the wall, and a two-sided form of the connector of the present invention that has fixed pins.
Figure 1B:
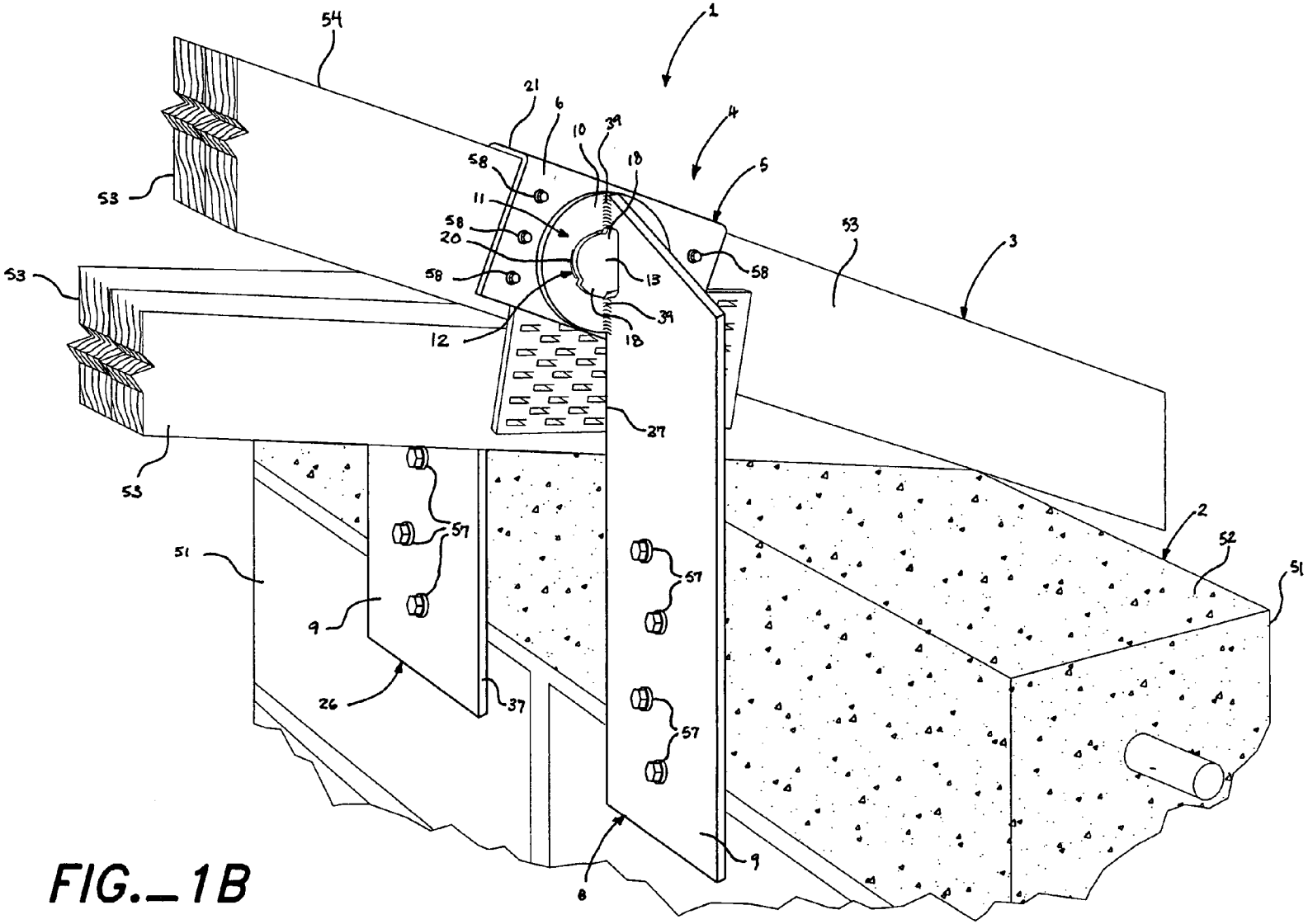
FIG. 1B is a perspective view of a concrete masonry wall, with a concrete tie beam surmounting the wall, supporting a pitched girder truss that is orthogonal to the wall and which overhangs the outer side of the wall, and a two-sided form of the connector of the present invention that has fixed pins.
Figure 1C:
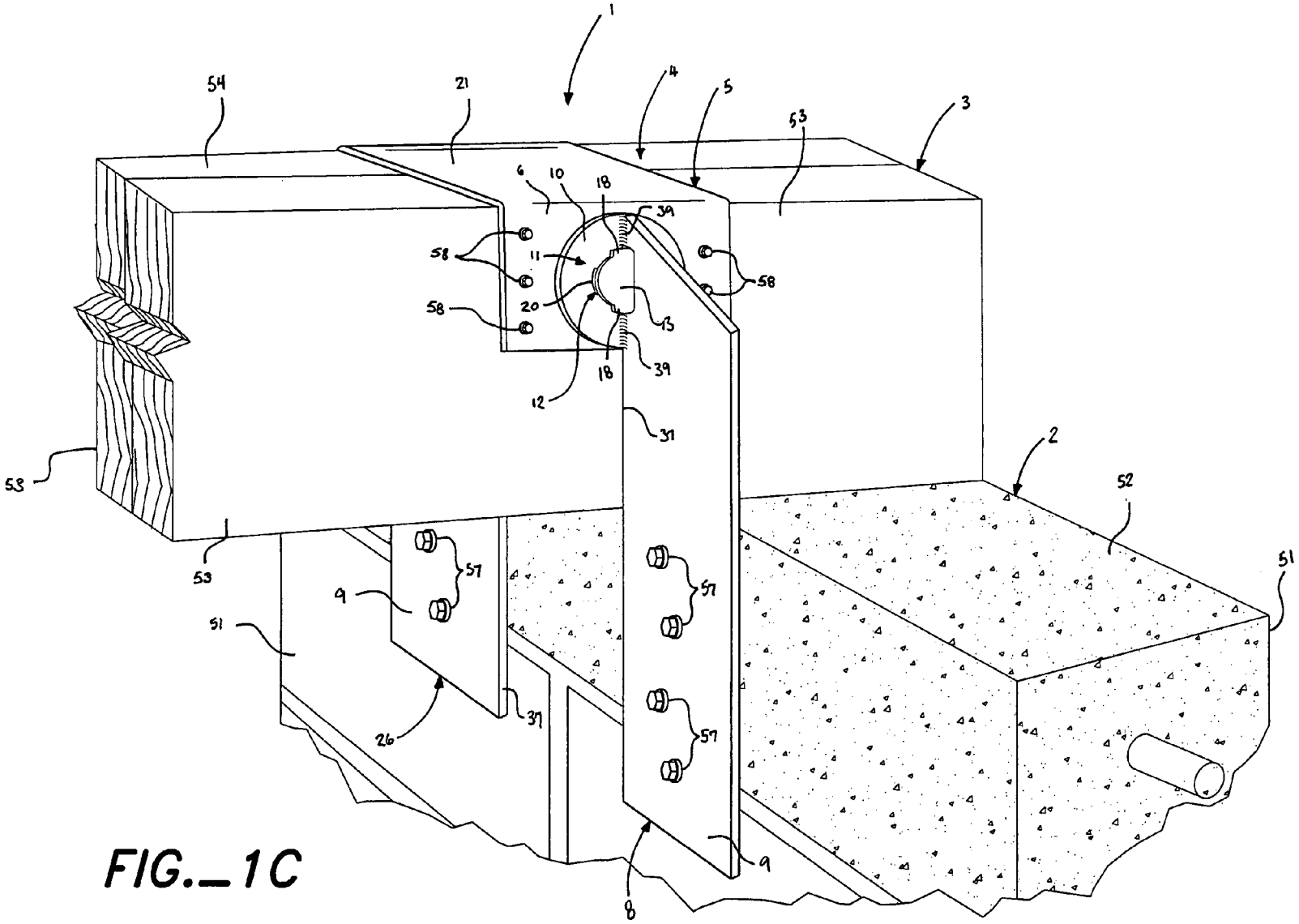
FIG. 1C is a perspective view of a concrete masonry wall, with a concrete tie beam surmounting the wall, supporting a flat girder truss that is orthogonal to the wall and ends at the outer side of the wall, and a two-sided form of the connector of the present invention that has fixed pins.
Figure 1D:
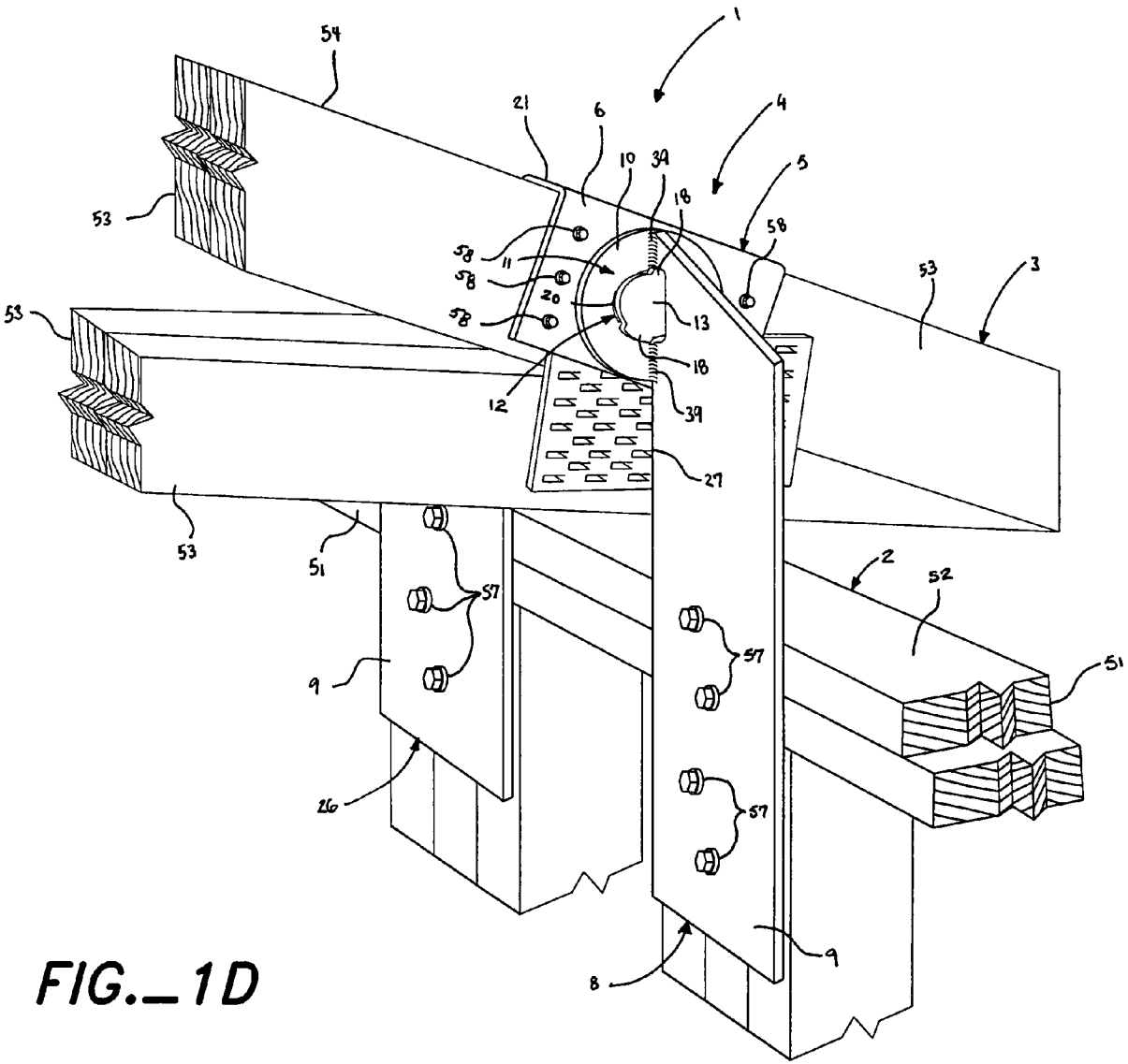
FIG. 1D is a perspective view of a wood frame wall, with a double top plate surmounting the wall, supporting a pitched girder truss that is orthogonal to the wall and which overhangs the outer side of the wall, and a two-sided form of the connector of the present invention that has fixed pins.
Figure 2:
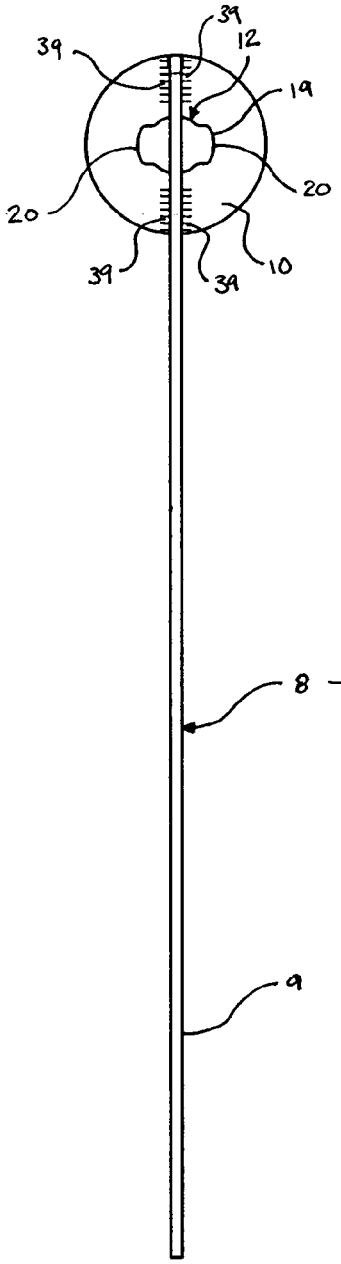
FIG. 2 is a side elevation view of an embodiment of the side attachment member of the connector of the present invention in which the connection portion is welded to the edge of the substantially planar attachment portion.

The elongate substantially vertical supporting structural member 2 is preferably a building wall 2, typically an exterior wall 2, possibly framed in wood, as shown in FIG. 1D, or steel, but typically a masonry wall 2, as shown in FIGS. 1A-1C, 10, 11, 15-19, 22-24, 28, 33 and 38A. In particular, the masonry wall 2 is illustrated as concrete block surmounted by a poured concrete tie beam. In all of Florida except the northernmost part, it is common to see structures built with concrete block masonry exterior walls 2. Concrete block is used because it has some inherent wind-resistance benefits, and because it resists termite infestation. It develops a good load path to resist uplift forces caused by wind, it is heavier than wood framing, a reinforced concrete block wall system creates fewer connection points than wood framing, which may imply fewer construction errors, and concrete block offers impact resistance to windborne debris. Concrete block exterior walls 2 are not composed solely of concrete block; instead, the concrete blocks usually sit within a grid of poured concrete and rebar. A key structural element of an exterior concrete block wall is usually the tie beams. The tie beam is located at the top 54 of the wall 2 and is either poured concrete or masonry bond beams (U-shaped concrete blocks filled with concrete). Poured concrete naturally creates a level tie beam, but it is only common in the southernmost part of Florida. In the prior art, hurricane straps that held down the roof trusses were placed in the still-wet concrete; if mislocated, they could be replaced by hurricane straps retrofitted to the tie beam with masonry anchors.

The elongate generally horizontal supported structural member 3 is preferably a roof member, such as a beam, girder, truss, girder truss or rafter 3. The particular connection that is shown in shown in FIGS. 1A-1D, 10, 11, 15-19, 22-24, 28, 33 and 38A is between a girder truss 3 and a wall 2. A girder truss 3 is a heavy truss from which other, lighter trusses may be suspended. Girder trusses 3 require stronger tie down connectors 4 because they generate high uplift forces, particularly in high wind areas and particularly when they overhang the outside of the wall 2. The greater the overhang, the more uplift is caused by wind loading. Larger overhangs are, however, particularly desirable in areas with a lot of rain, which are also typically areas with high winds.

The connector 4 of the present invention improves on the prior art by providing an exceptionally strong connection 1 between trusses 3 and walls 2 that need not be cast in concrete, is suitable for both original and retrofit installations, and is adjustable to accommodate trusses 3 of various pitches. At its most basic, the connector 4 comprises a cap 5, connected to said supported structural member 3, a first side attachment member 8 and a pin connection 11 between the cap 5 and the first side attachment member 8. The cap 5 comprises a first substantially planar side attachment portion 6 that interfaces with the supported structural member 3. The first side attachment member 8 comprises a substantially planar attachment portion 9 lying in the first plane and a connection portion 10 comprising a plate attached to the planer attachment portion 9, lying in a second plane, wherein the second plane is not in the same plane as the first plane, the attachment portion 9 interfaces with and is fastened to the supporting structural member 2, and connection portion 10 is positioned alongside the first substantially planar side attachment portion 6 of the cap 5. The first pin connection 11 enables rotation between the cap 5 and the first side attachment member 8, and that connects said cap to said first attachment member 8, and that connects said cap to said first attachment member 8, so that the cap 5 can be attached to 20 supported structural members 8 of various pitches.

There are several primary variations on the basic form of the connector 4 of the present invention. The connector 4 can be either one-sided or two-sided, having either only a first side attachment member 8 when it is one-sided or a first side attachment member 8 and a second side attachment member 26 when it is two-sided. The cap 5 can take several different basic forms. The pin connections 11 can either have pin 13 that is fixed to either the cap 5 or the one of the first and second side attachment members 8 and 26, or a pin 13 that is separate from the cap 5 and the first and second side attachment members 8 and 26. If the pin 13 is fixed, it passes through one pin opening 12 in the cap 5 or the one of the first and second side attachment members 8 and 26. If the pin 13 is separate, it passes through two matching pin openings 12 in the cap 5 and one of the first and second side attachment members 8 and 26. If the connector 4 is one-sided, it will preferably have one side attachment member 8 positioned to one side of the supported structural member 3. If the connector 4 is two-sided it will preferably have two side attachment members 8 and 26, one on each side of the supported structural member 3. The cap 5 can take three basic forms. First, an inverted U-shaped, with two substantially planar side attachment portions 6 and 22 that interface with the sides 53 of the supported structural member 3 and a substantially planar top attachment portion 21 that connects the two substantially planar side attachment portions 6 and 22. Second, an inverted L-shape (if the connection is one-sided) or a pair of inverted L-shapes (if the connection is two-sided), the L-shape having a substantially planar side attachment portion 6 or 22 and a substantially planar top attachment portion 21. Third, one (if the connection is one-sided) or two (if the connection is two-sided) substantially planar side attachment portions 6 and 22. All three basic forms of the cap 5 can be fastened to the supported structural member 3 using fasteners 55 such as nails, screws or bolts. The cap 5 could also be bonded to the supported structural member 3 using adhesives or welds, depending on the materials used to compose the cap 5 and the supported structural member 3. Preferably, the connector 4 will be made from steel and the supported structural member 3 will be made primarily of wood, but the connector 4 might also be made of other metals, plastics or composites, and the same is true of the supported structural member 3. When fasteners 55 are used to fasten the cap 5 to the supported structural member 3, the fasteners 55 can pass through the substantially planar side attachment portion or portions 6 and the substantially planar top attachment portion or portions 21. Because the connector 4 is designed primarily to resist uplift forces, fasteners 55 or other bonding is only critical when the cap 5 has no substantially planar top attachment portion 21. In the preferred embodiment of this form, fasteners 55 pass through the substantially planar side attachment portion or portions 6 into the side or sides 53 of the supported structural member 3.

As shown in FIGS. 2, 4, 20, 25 and 40, preferably the first pin connection 11 further comprises a first pin opening 12 in one of the cap 5 and the first side attachment member 8, and a first pin 13 that passes through the first pin opening 12. As shown in FIGS. 42-45, the first pin 13 preferably comprises a body 14 that has a circumference 15, a first end 16, and a second end 17 with a first restraint extension 18 that extends beyond the circumference 15 of the body 14. As shown in FIGS. 2, 4, 20, 25, 29 and 40, the first pin opening 12 has a circumference 19. The first restraint extension 18 extends beyond the circumference of the first pin opening 12, preventing the first pin 13 from withdrawing from the first pin opening 12.

FIRST PREFERRED EMBODIMENT

In the first preferred embodiment, the first pin 13 is fixedly attached to the other of the cap 5 and the first side attachment member 8 that does not have a first pin opening 12. Preferably, as shown in FIG. 1A, the first pin 13 is fixedly attached to the cap 5 and the first pin opening 12 is in the first side attachment member 8.

Preferably, the first restraint extension 18 is one or more lobes 18 that extend beyond the circumference 15 of the body 14 and the circumference 19 of the first pin opening 12. Preferably, the first pin opening 12 has one or more open lobes 20 that extend beyond the circumference 19 of the first pin opening 12. Preferably, the fixedly attached first pin 13 is inserted through the first pin opening 12 in an orientation that permits the one or more lobes 18 on the first pin 13 to pass through the one or more open lobes 20 of the first pin opening 12, and the cap 5 and the first side attachment member 8 are then rotated on the first pin connection 11 so that the one or more lobes 18 on the first pin 13 no longer match the one or more open lobes 20 of the first pin opening 12, thereby restraining the cap 5 and the first side attachment member 8 from being separated at the first pin connection 11. The open lobes 20 permit the first side attachment member 8 and the cap 5 to be separated and reconnected. The open lobes 20 are preferably oriented so that they will be 90 degrees off of the lobes 18 when the supported structural member 3 is perfectly horizontal and the supporting structural member 2 is perfectly vertical, so that an interlock is formed in every orientation except if the supported structural member 3 is perfectly vertical, which is essentially impossible when the supported structural member 3 is a truss or other similar roofing member. Preferably, the pins 13 are machined from 1¾" diameter hot rolled bar stock with CNC (computer numerical control) lathes and machining centers. Preferably, the pins 13 each have two opposed lobes 18 that are ⅞" wide and extend to the 1¾" diameter of the bar stock. Preferably, the thickness of the lobes 18 is approximately one third the length of the pins 13. The middle third of the pin 13 is preferably 1.312" in diameter while the remaining third is preferably 1.245" in diameter with a flat portion of the circumference making it roughly D-shaped. As shown in FIGS. 30-32 and 42-46, the pins 13 are preferably fixed to the cap 5 by being inserted in D-shaped apertures 30 in the substantially planar side attachment portions 6 and 22 until the pins are flush with the insides of the substantially planar side attachment portions 6 and 22 and then welded on the insides of the substantially planar side attachment portions 6 and 22 with fillet welds 39 that go around the circumferences of the D-shaped apertures. The D shape ensures that the pins 13 cannot rotate so that the welds 39 are not stressed by torsion.

Preferably, the cap 5 additionally comprises a substantially planar top attachment portion 21 that interfaces with the supported structural member 3. As shown in FIGS. 11-19, 22-24 and 28, the cap 5 could be formed with a first substantially planar attachment portion 6 in the case of a one-sided variant of the connector 4, and the cap 5 can be formed with first and second substantially planar attachment portions 6 and 22 that are not connected. However, as shown in FIGS. 1A-1D, 6-10, and 31-33, the cap can be formed with first and second substantially planar attachment portions 6 and 22 that are connected by a substantially planar top attachment portion 21. The width of the cap 5 varies according to the width of the supported structural member 3, which is usually made from nominal 2×4 lumber. For 2-ply, 3-ply, 4-ply and 5-ply supported structural members 3, the width of the cap is preferably approximately 3½", 5.062", 7¼" and 8.312", respectively. With the forms of the connector 4 of the present invention in which the cap 5 has a top attachment portion 21, the fixed pins 13 herein described can be advantageous because they allow the side attachment members 8 and 26 to be separated from the cap member 5, making the parts somewhat interchangeable.

Preferably, the cap 5 can additionally comprise a second substantially planar side attachment portion 22 that interfaces with the supported structural member 3. In a single-sided variant of the connector 4 of the present invention, a second side attachment portion 22 is not strictly necessary. When the cap 5 has only a first side attachment portion 6, a plurality of fasteners 58 are necessary to resist uplift, but when the cap 5 has a top attachment portion 21, the top attachment portion 21 can resist uplift and the fasteners 58 are less important.

Figure 3:
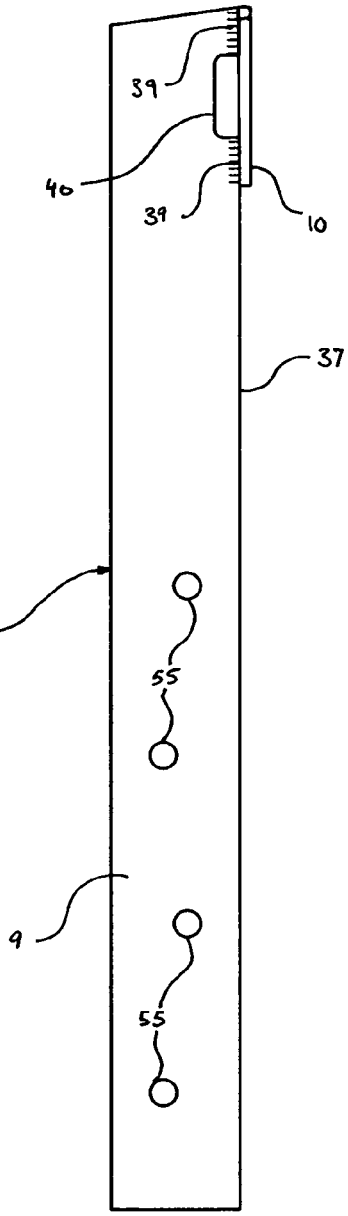
FIG. 3 is a front elevation view of an embodiment of the side attachment member of the connector of the present invention in which the connection portion is welded to the edge of the substantially planar attachment portion.

Preferably, as shown in FIG. 3, the first side attachment member 8 additionally comprises an edge 37 on said substantially planar attachment portion 9 and the connection portion 10 of the first side attachment member 8 is attached to the edge 37. While it is possible to make a completely flat first side attachment member 8, as shown in FIGS. 19-23, this is normally only used at the ends of the supporting structural member 2. As shown in FIGS. 1A-5, 10, 11 and 15, the substantially planar attachment portion 9 and the connection portion 10 of the first side attachment member 8 are orthogonally related so that the attachment portion 9 faces a side 51 of the supporting structural member 2 and the connection portion 10 faces a side 53 of the supported structural member 3 and the cap 5.

Preferably, as shown in FIG. 1A, the substantially planar side attachment portion 9 of the first side attachment member 8 additionally comprises fastener openings 55, and the connection 1 additionally comprises fasteners 57 that pass through the fastener openings 55 in the first substantially planar side attachment portion 9 of the first side attachment member 8 and into the supporting structural member 2. Alternatively, the first side attachment member 8 could be made without fastener openings 55, and could be fastened to the supporting structural member 2 either with fasteners 57 that pierce the first side attachment member 8, an adhesive, or welds (if the supporting structural member 2 and the connector 4 are both made of metal).

Figure 7:
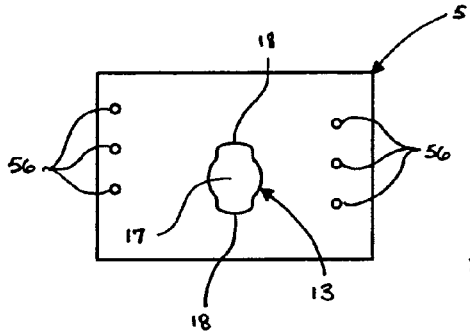
FIG. 7 is a side elevation view of an embodiment of the cap of the connector of the present invention in which the cap has two substantially planar side attachment members joined by a substantially planar top attachment portion and two fixed pins with restraint extensions in the form of twin lobes.
Figure 8:
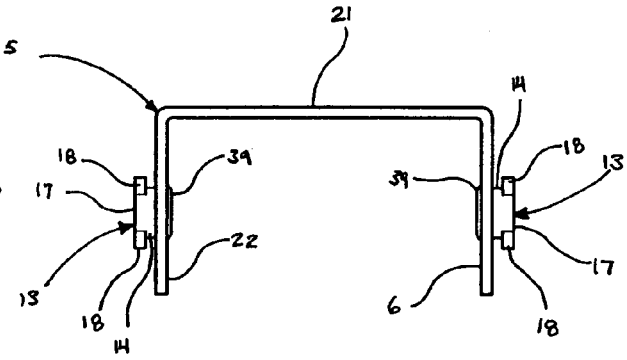
FIG. 8 is a front elevation view of an embodiment of the cap of the connector of the present invention in which the cap has two substantially planar side attachment members joined by a substantially planar top attachment portion and two fixed pins with restraint extensions in the form of twin lobes.
Figure 9:
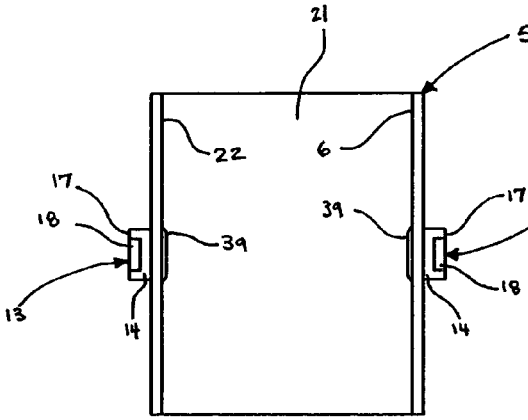
FIG. 9 is a bottom plan view of an embodiment of the cap of the connector of the present invention in which the cap has two substantially planar side attachment members joined by a substantially planar top attachment portion and two fixed pins with restraint extensions in the form of twin lobes.
Figure 10:
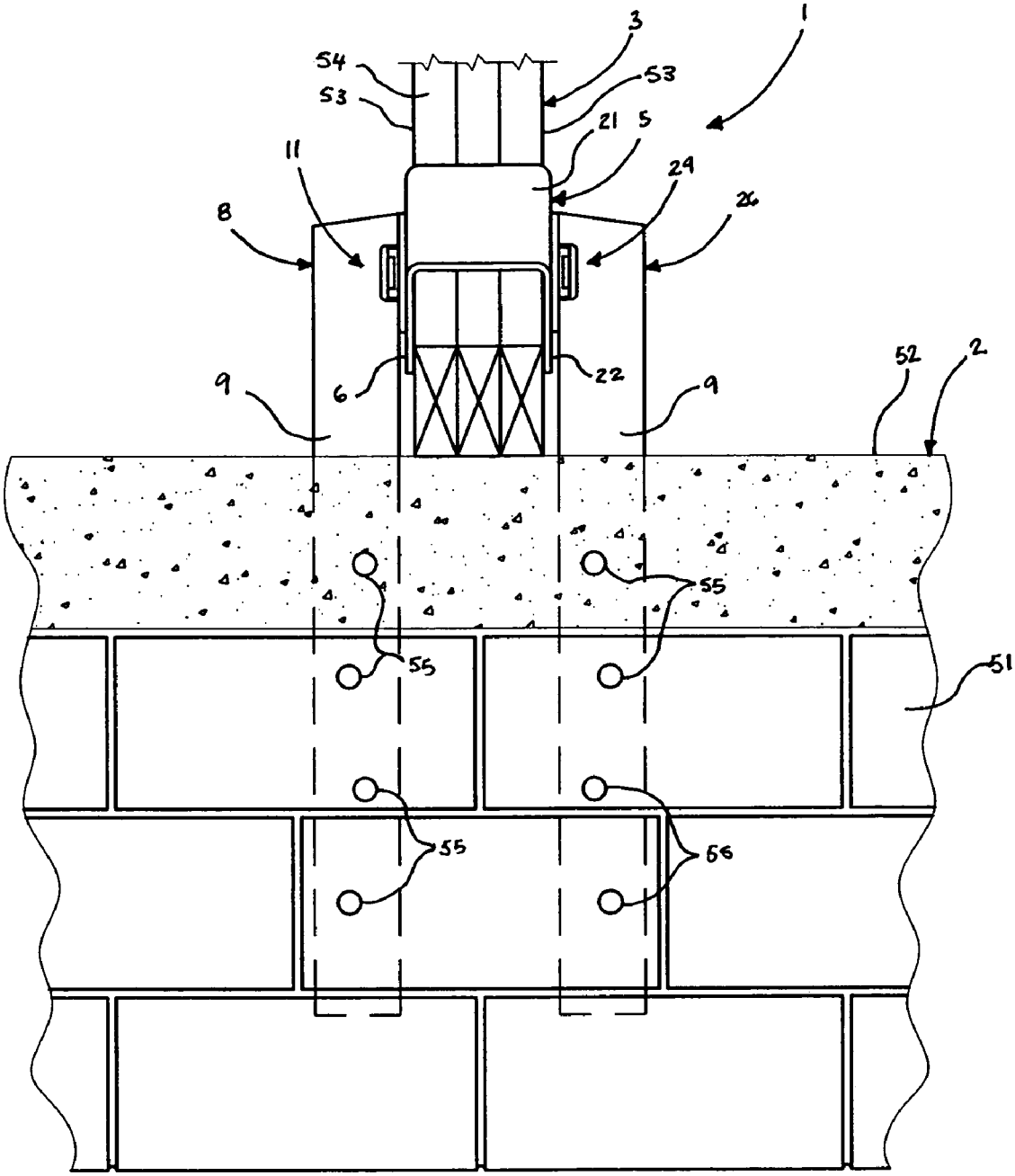
FIG. 10 is an elevation view of the outer side of a concrete masonry wall, with a concrete tie beam surmounting the wall, supporting a pitched girder truss that is orthogonal to the wall, and a two-sided form of the connector of the present invention that has fixed pins and a cap that has two substantially planar side attachment members joined by a substantially planar top attachment portion.

Preferably, as shown in FIG. 7, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Alternatively, the cap 5 could be made without fastener openings 56, and could be fastened to the supported structural member 3 either with fasteners 58 that pierce the cap 5, an adhesive, or welds (if the supported structural member 3 and the connector 4 are both made of metal). When the cap 5 has no top attachment portion 21, the fasteners 58 are critical because uplift is transferred from the supported structural member 3 solely through the fasteners 58 to the connector 4 and the supporting structural member 2.

Preferably, the fasteners 57 that pass through the fasteners openings 55 in the first substantially planar side attachment portion 9 of the first side attachment member 8 are masonry screw anchors 57, and the fasteners 58 that pass through the fasteners openings 56 in the first and second substantially planar side attachment portions 6 and 22 of the cap 5 are self-drilling wood screws 58. Most preferably, the fasteners 57 are Simpson Strong-Tie Titen HD masony screw anchors. Most preferably, the fasteners 58 are Simpson Strong-Tie SDS Strong Drive screws.

Figure 32:
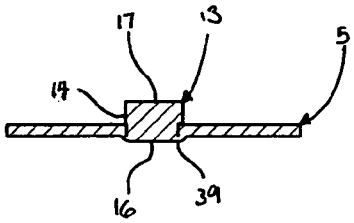
FIG. 32 is a cross-sectional view of an embodiment of the cap of the connector of the present invention in which the cap has two substantially planar side attachment members joined by a substantially planar top attachment portion and showing the fixed pin in detail.

Preferably, as shown in FIG. 32, the first end 16 of the first pin 13 is welded to the cap 5. Alternatively, the first pin 13 could be attached by a mechanical interlock, adhesive, or the like. Otherwise, the first pin 13 and the cap 5 could be cast, molded or otherwise formed as a single piece.

Figure 11:
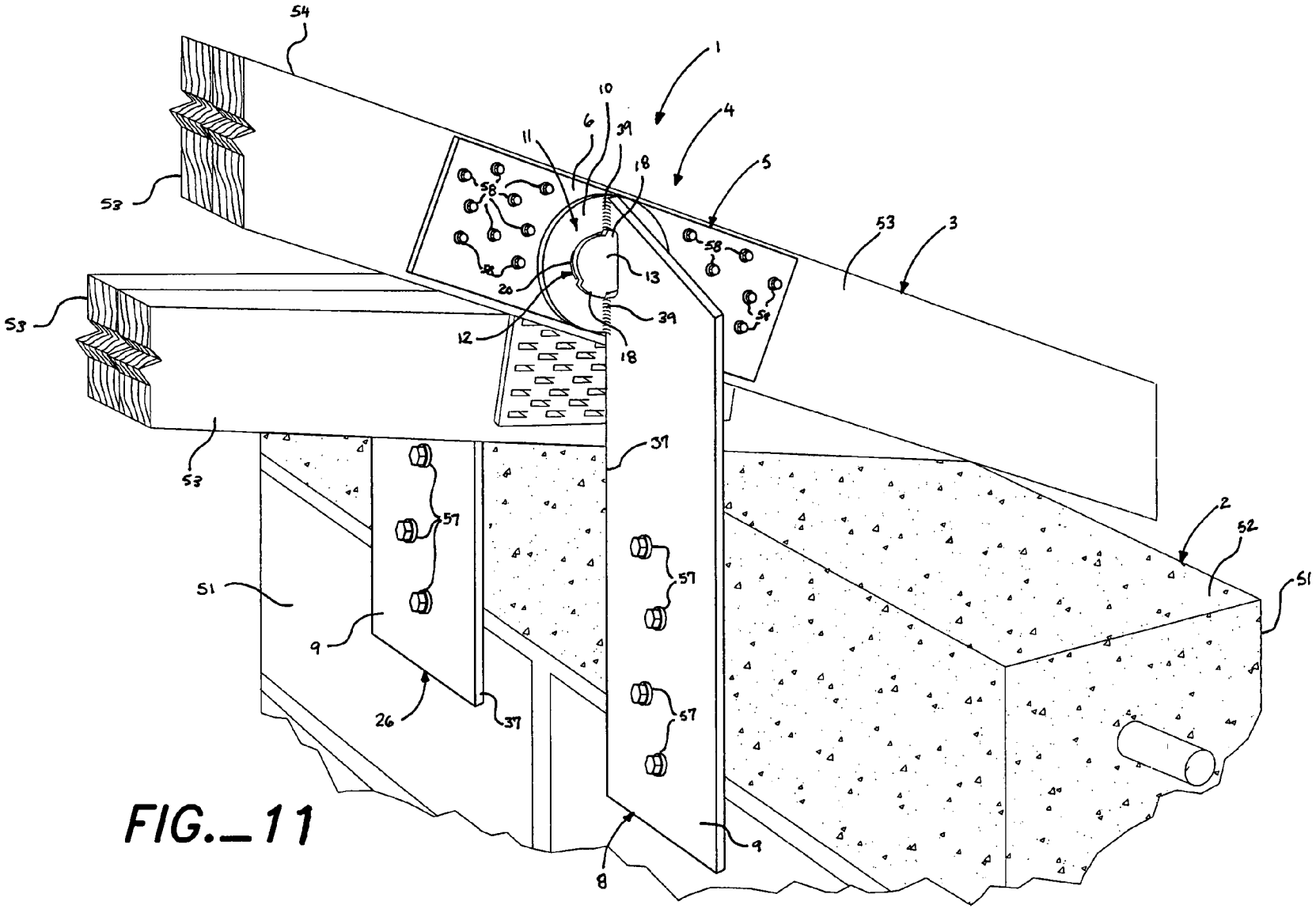
FIG. 11 is a perspective view of a concrete masonry wall, with a concrete tie beam surmounting the wall, supporting a pitched girder truss that is orthogonal to the wall and which overhangs the outer side of the wall, and a two-sided form of the connector of the present invention that has fixed pins and a split cap that has two substantially planar side attachment portions but no substantially planar top attachment portion connecting the two.
Figure 12:
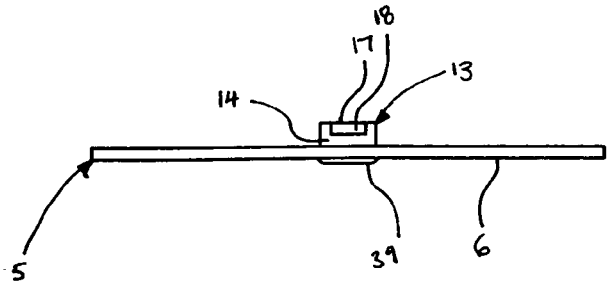
FIG. 12 is a top plan view of an embodiment of the cap of the connector of the present invention in which the cap has one substantially planar side attachment member and a fixed pin with a restraint extension in the form of twin lobes.
Figure 13:
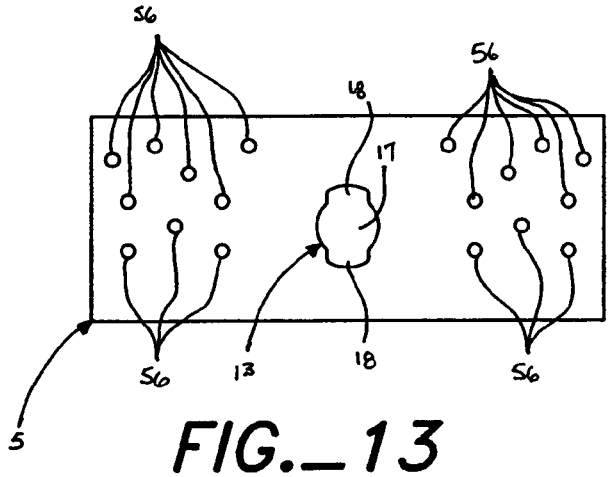
FIG. 13 is a side elevation view of an embodiment of the cap of the connector of the present invention in which the cap has one substantially planar side attachment member and a fixed pin with a restraint extension in the form of twin lobes.
Figure 14:
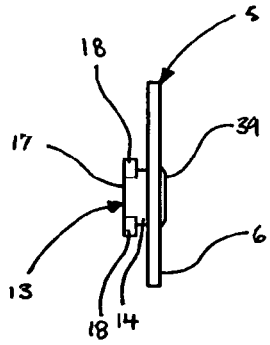
FIG. 14 is a front elevation view of an embodiment of the cap of the connector of the present invention in which the cap has one substantially planar side attachment member and a fixed pin with a restraint extension in the form of twin lobes.
Figure 15:
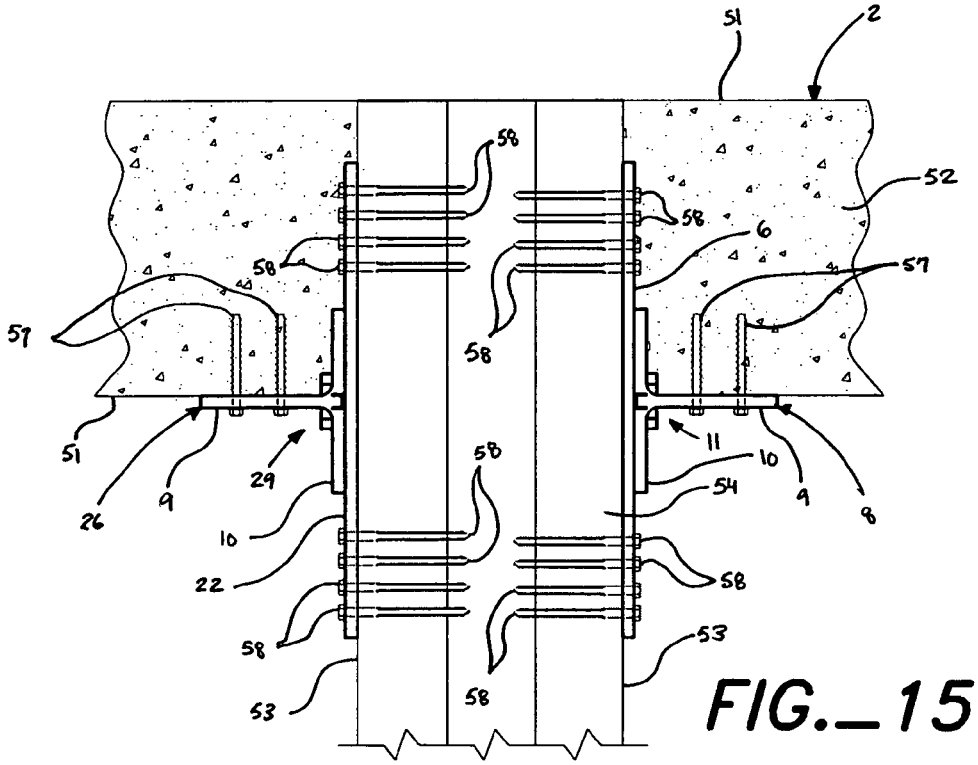
FIG. 15 is a top plan view of an embodiment of the cap of the connector of the present invention in which the cap has two separate substantially planar side attachment members and two fixed pins with restraint extensions in the form of twin lobes.
Figure 16:
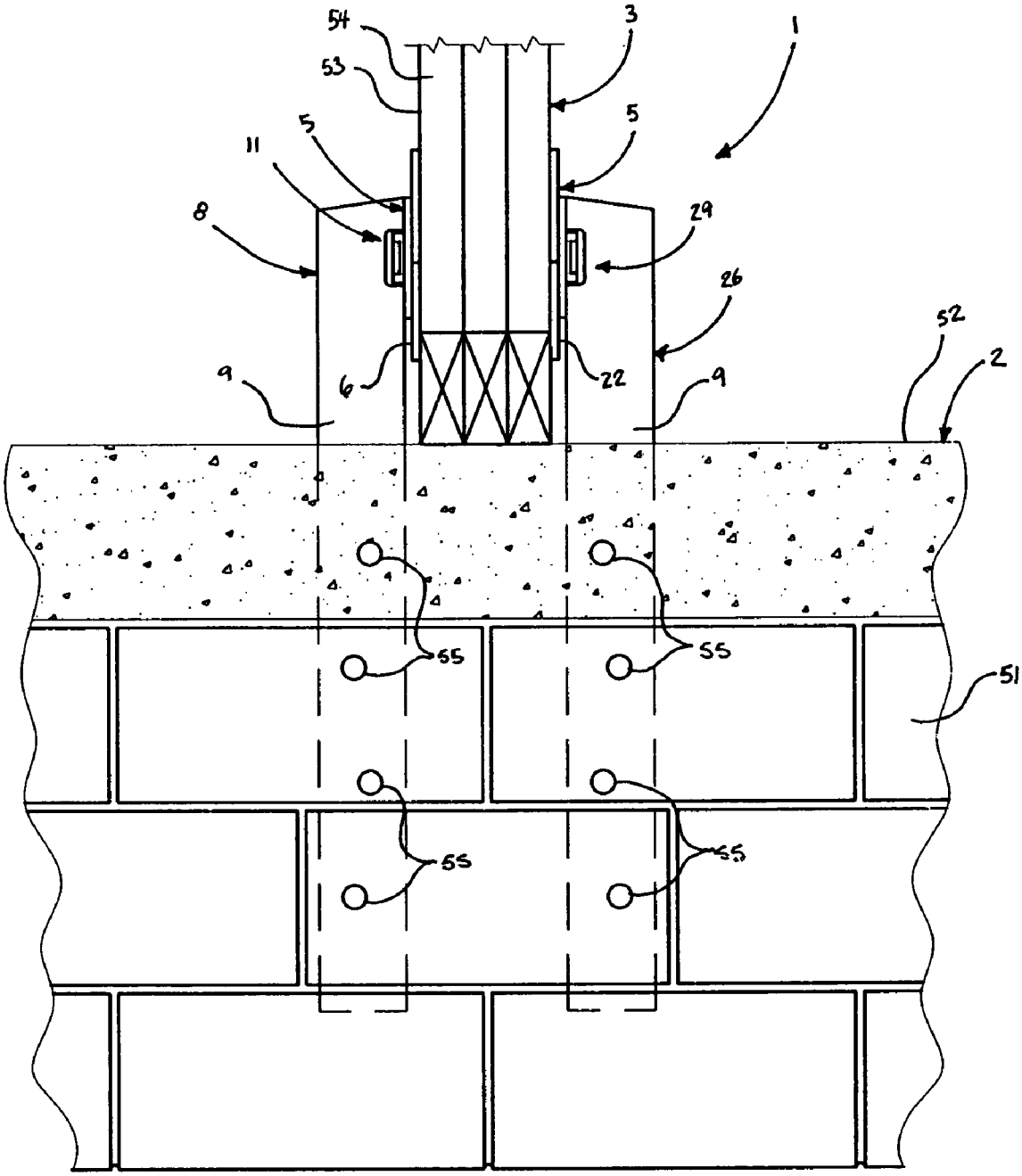
FIG. 16 is an elevation view of the outer side of a concrete masonry wall, with a concrete tie beam surmounting the wall, supporting a pitched girder truss that is orthogonal to the wall, and a two-sided form of the connector of the present invention that has fixed pins and a cap that has two separate substantially planar side attachment members.
Figure 24:
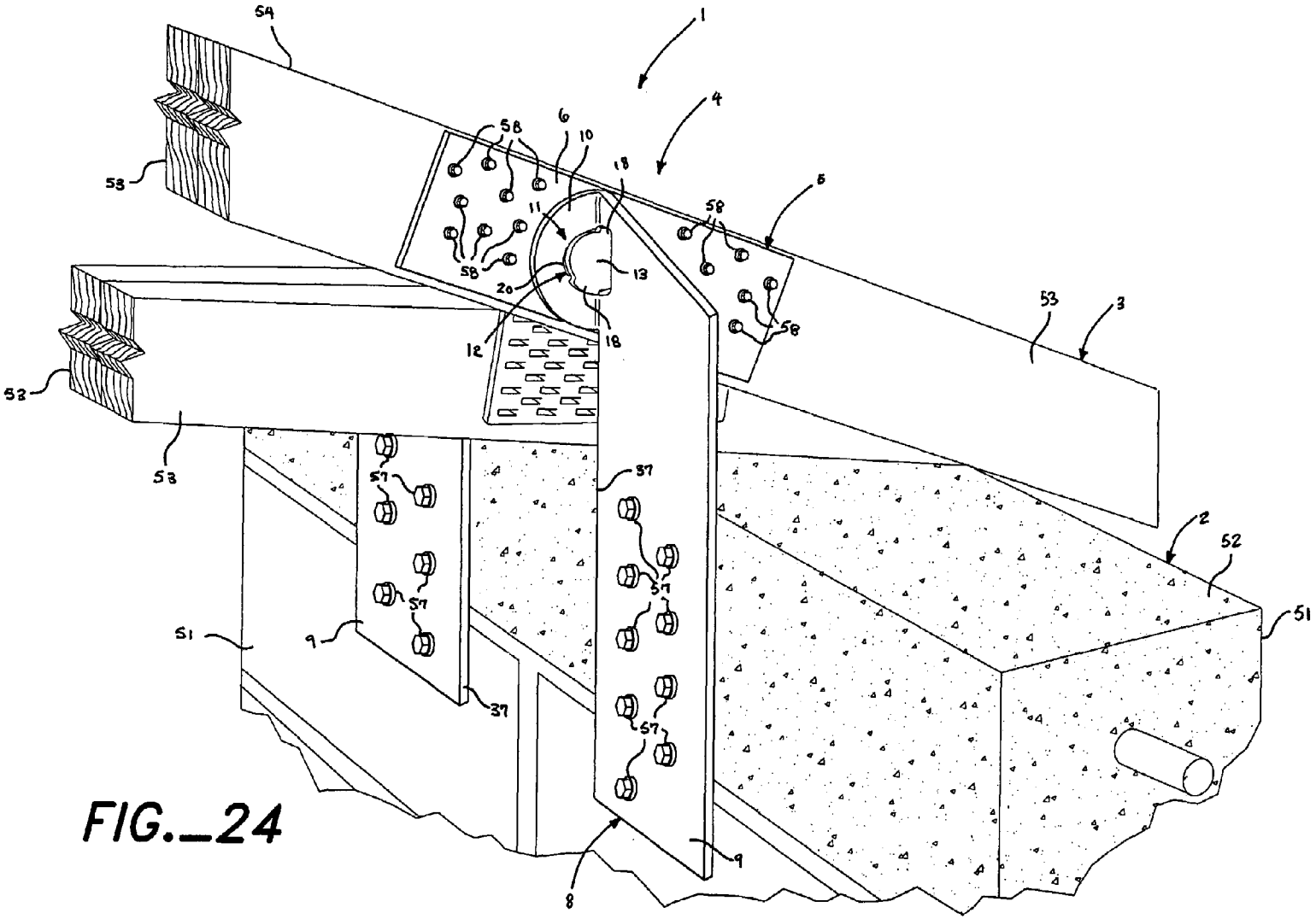
FIG. 24 is a perspective view of a concrete masonry wall, with a concrete tie beam surmounting the wall, supporting a pitched girder truss that is orthogonal to the wall and which overhangs the outer side of the wall, and a two-sided form of the connector of the present invention that has fixed pins and a split cap that has two substantially planar side attachment portions but no substantially planar top attachment portion connecting the two.

Preferably, as shown in FIG. 11, the connection portion 10 of the first side attachment member 8 is welded to the edge 37. Alternatively, the substantially planar side attachment portion 9 and the connection portion 10 could be attached by a mechanical interlock, adhesive, or the like. Otherwise, substantially planar side attachment portion 9 and the connection portion 10 could be cast, molded or otherwise formed as a single piece, as shown in FIG. 24. Equally, the substantially planar side attachment portion 9 and the connection portion 10 could be bent out of a single piece of metal or other material. Preferably, the connector 4 is painted. Welding destroys the corrosion protection of galvanized steel and therefore requires painting.

SECOND PREFERRED EMBODIMENT

In the second preferred embodiment, the first pin 13 is fixedly attached to the first side attachment member 8 and the first pin opening 12 is in the cap 5. This particular arrangement, according to which the first pin 13 is fixedly attached to the first side attachment member 8, is similar to fixedly attaching the first pin 13 to the cap 5 and is, therefore, not shown in the drawings. This is less preferred than attaching the first pin 13 to the cap member 5, but it would be a functional alternative. As in the first preferred embodiment, and the first restraint extension 18 is one or more lobes 18 that extend beyond the circumference 15 of the body 14 and the circumference 19 of the first pin opening 12, and the first pin opening 12 has one or more open lobes 20 that extend beyond the circumference 19 of the first pin opening 12. The fixedly attached first pin 13 is inserted through the first pin opening 12 in an orientation that permits the one or more lobes 18 on the first pin 13 to pass through the one or more open lobes 20 of the first pin opening 12, and the cap 5 and the first side attachment member 8 are then rotated on the first pin connection 11 so that the one or more lobes 18 on the first pin 13 no longer match the one or more open lobes 20 of the first pin opening 12, thereby restraining the cap 5 and the first side attachment member 8 from being separated at the first pin connection 11. The cap 5 additionally comprises a substantially planar top attachment portion 21 that interfaces with the supported structural member 3. Preferably, the cap 5 additionally comprises a second substantially planar side attachment portion 22 that interfaces with the supported structural member 3, and the first side attachment member 8 additionally comprise an edge 37 and the connection portion 10 of the first side attachment member 8 is attached to the edge 37.

Preferably, the substantially planar side attachment portion 9 of the first side attachment member 8 additionally comprises fastener openings 55, and the connection 1 additionally comprises fasteners 57 that pass through the fastener openings 55 in the first substantially planar side attachment portion 9 of the first side attachment member 8 and into the supporting structural member 2. Preferably, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Preferably, the fasteners 57 that that pass through the fastener openings 55 in the first substantially planar side attachment portion 9 of the first side attachment member 8 are masonry screw anchors 57, and the fasteners 58 that pass through the fastener openings 56 in the first and second substantially planar side attachment portions 6 and 22 of the cap 5 are self-drilling wood screws 58.

Preferably, the first end 16 of the first pin 13 is welded to the first side attachment member 8, the connection portion 10 of the first side attachment member 8 is welded to the edge 37, and the connector 4 is painted.

THIRD PREFERED EMBODIMENT

The third preferred embodiment is essentially the same as the first preferred embodiment, except that it is double-sided. It is always preferable that the connection of the present invention be double-sided because a single-sided connection is weaker than its double-sided counterpart. It is shown FIGS. 1A-1D and 10. In it, the cap additionally comprises a second substantially planar side attachment portion 22 that interfaces with the supported structural member 3. The connector 4 additionally comprises a second side attachment member 26 comprising a substantially planar attachment portion 9 lying in a first plane and a connecting portion 10 comprising a plate attached to the planner attachment portion 9, lying in a second plane, wherein the second plane is not in the same plane as the first plane, the attachment portion 9 interfaces with and is fastened to the supporting structural member 2, and the connection portion 10 is positioned alongside the first substantially planar attachment portion 6 of the cap 5, and a second pin connection 29 that enables rotation between the second side attachment member 26 and the cap 5.

Figure 19:
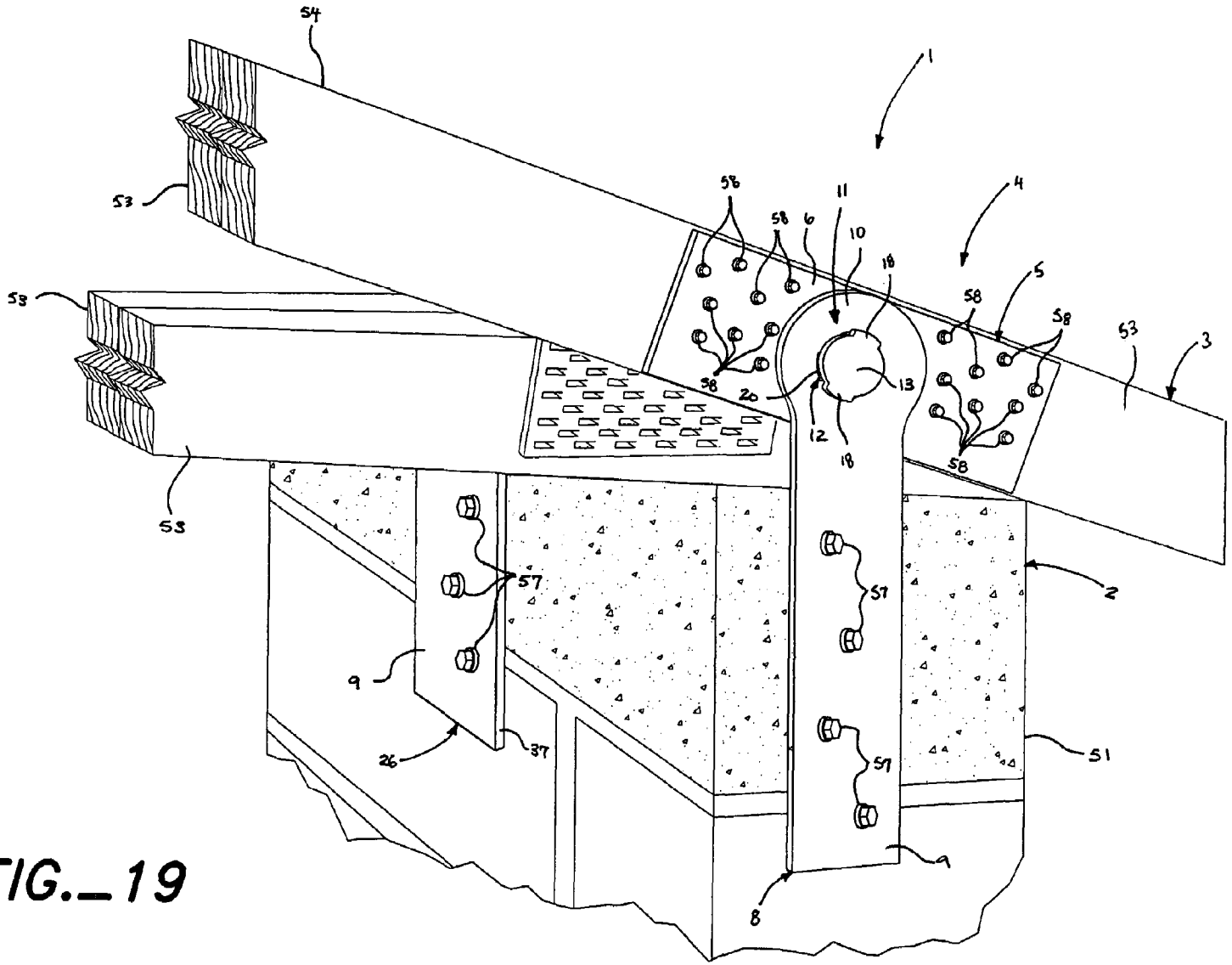
FIG. 19 is a perspective view of a concrete masonry wall, with a concrete tie beam surmounting the wall, supporting a pitched girder truss that is orthogonal to and at the end of the wall and overhangs the outer side of the wall, and a two-sided form of the connector of the present invention that has one side attachment member with a substantially planar attachment portion and a connection portion in the same plane and a fixed pin.
Figure 20:
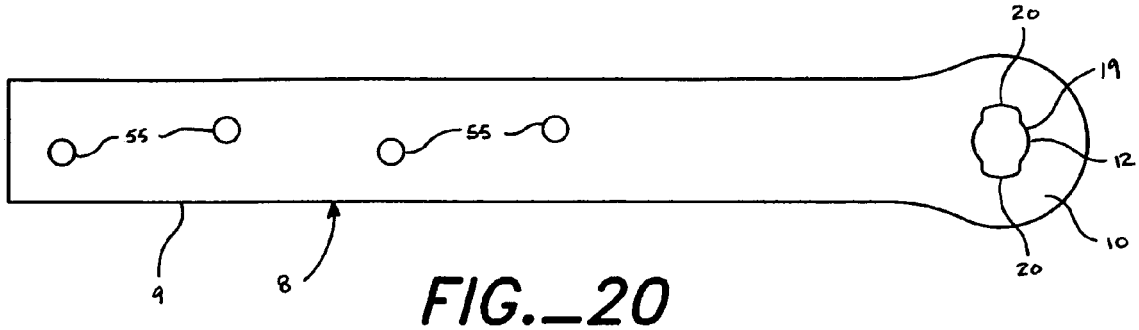
FIG. 20 is an elevation view of an embodiment of the side attachment member with a substantially planar attachment portion and a connection portion in the same plane and a fixed pin.
Figure 21:
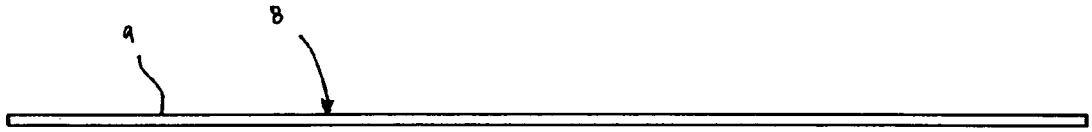
FIG. 21 is a top plan view of an embodiment of the side attachment member with a substantially planar attachment portion and a connection portion in the same plane and a fixed pin.
Figure 22:
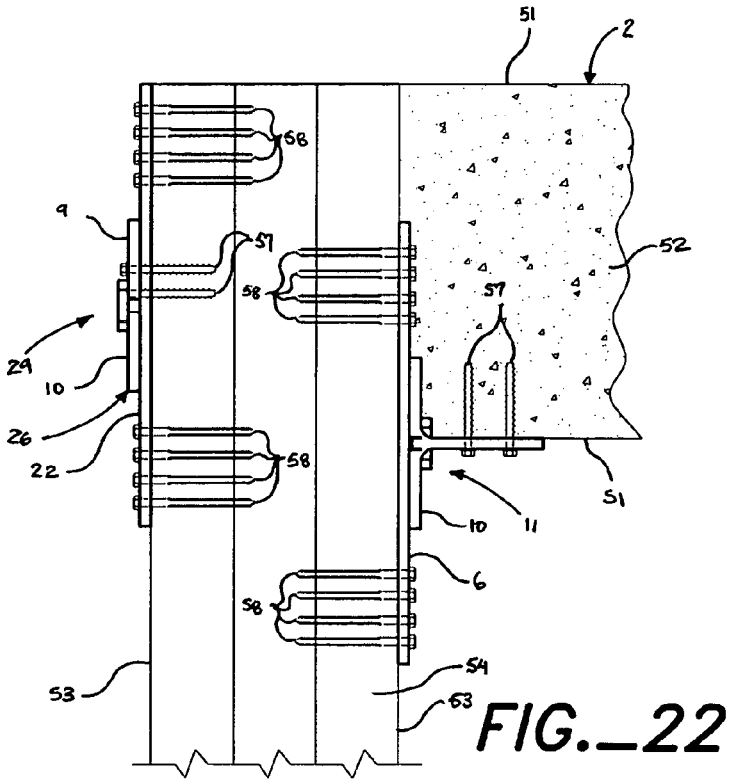
FIG. 22 is a top plan view of a concrete masonry wall, with a concrete tie beam surmounting the wall, supporting a pitched girder truss that is orthogonal to and at the end of the wall and overhangs the outer side of the wall, and a two-sided form of the connector of the present invention that has one side attachment member with a substantially planar attachment portion and a connection portion in the same plane and a fixed pin.
Figure 23:
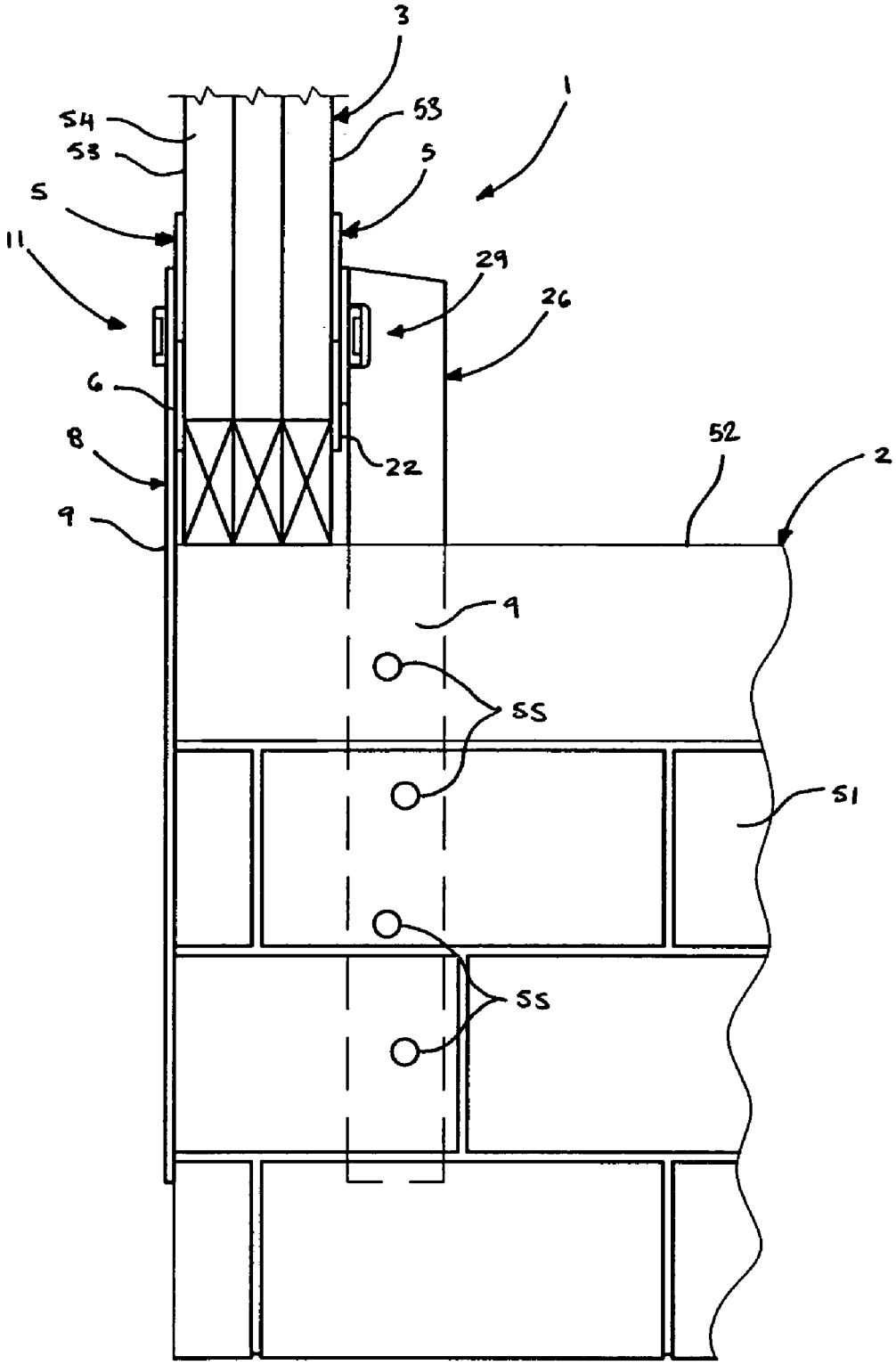
FIG. 23 is an elevation view of the outer side of a concrete masonry wall, with a concrete tie beam surmounting the wall, supporting a pitched girder truss that is orthogonal to and at the end of the wall and overhangs the outer side of the wall, and a two-sided form of the connector of the present invention that has one side attachment member with a substantially planar attachment portion and a connection portion in the same plane and a fixed pin.

The cap 5 further comprises a second substantially planar side attachment portion 22 that interfaces with the supported structural member 3 opposite the first substantially planar side attachment portion 6. The second pin connection 29 further comprises a second pin opening 12 in one of the cap 5 and the second attachment member 26, and a second pin 13 that passes through the second pin opening 12, the second pin 13 comprises a body 14 having a circumference 15, a first end 16, and a second end 17 with a first restraint extension 18 that extends beyond the circumference 15 of the body 14. The second pin opening 12 has a circumference 19, and the first restraint extension 18 extends beyond the circumference of the second pin opening 12, preventing the second pin 13 from withdrawing from the second pin opening 12. The second pin 13 is fixedly attached to the other of the cap 5 and the second side attachment member 26 that does not have a second pin opening 12. Preferably, the first and second side attachment members 8 and 26 are essentially the same, either identical or mirror images of each other, except in an end wall attachment as shown in FIGS. 19, 22 and 23, where it is practical to use a side attachment member 8 or 26 that is flat or when the supported structural member 3 is not orthogonal to the supporting structural member 2. Preferably, the pin connections 11 and 29 are essentially the same, either identical or mirror images of each other.

Preferably, the first pin 13 is fixedly attached to the cap 5 and the first pin opening 12 is in the first side attachment member 8, and the second pin 13 is fixedly attached to the cap 5 and the second pin opening 12 is in the second side attachment member 26. Preferably, the first restraint extension 18 of the first pin 13 is one or more lobes 18 that extend beyond the circumference 15 of the body 14 and the circumference 19 of the first pin opening 12, and the first restraint extension 18 of the second pin 13 is one or more lobes 18 that extend beyond the circumference 15 of the body 14 and the circumference 19 of the second pin opening 12. Preferably, the first pin opening 12 has one or more open lobes 20 that extend beyond the circumference 19 of the first pin opening 12. The fixedly attached first pin 13 is preferably inserted through the first pin opening 12 in an orientation that permits the one or more lobes 18 on the first pin 13 to pass through the one or more open lobes 20 of the first pin opening 12, and the cap 5 and the first side attachment member 8 are then rotated on the first pin connection 11 so that the one or more lobes 18 on the first pin 13 no longer match the one or more open lobes 20 of the first pin opening 12, thereby restraining the cap 5 and the first side attachment member 8 from being separated at the first pin connection 11. Preferably, the second pin opening 12 has one or more open lobes 20 that extend beyond the circumference 19 of the second pin opening 12. The fixedly attached second pin 13 is preferably inserted through the second pin opening 12 in an orientation that permits the one or more lobes 18 on the second pin 13 to pass through the one or more open lobes 20 of the second pin opening 12, and the cap 5 and the second side attachment member 26 are then rotated on the second pin connection 29 so that the one or more lobes 18 on the second pin 13 no longer match the one or more open lobes 20 of the second pin opening 12, thereby restraining the cap 5 and the second side attachment member 26 from being separated at the first pin connection 29.

Preferably, the cap 5 additionally comprises a substantially planar top attachment portion 21 that interfaces with the supported structural member 3. The second substantially planar side attachment portion 22 of the cap 5 is attached to the substantially planar top attachment portion 21. Preferably, the first side attachment member 8 additionally comprises an edge 37 on said substantially planar attachment portion 9 and the connection portion 10 of the first side attachment member 8 is attached to the edge 37. Preferably, the second side attachment member 26 additionally comprises an edge 37 and the connection portion 10 of the second side attachment member 26 is attached to the edge 37.

As best shown in FIG. 3, the substantially planar attachment portions 9 preferably each have two parallel long edges 37 and two short edges 37 that connect the long side edges 37. The short edge 37 farthest away from the connection portion 10 preferably meets both the long edges 37 at right angles. The short edge 37 nearest the connection portion 10 preferably meets the long edges 37 at 8.14 degrees off of orthogonal, so that the long edge 37 to which the connection portion 10 is attached is longer than the opposite long edge 37.

Preferably, the substantially planar side attachment portion 9 of the first side attachment member 8 and the substantially planar side attachment portion 9 of the second side attachment member 26 additionally comprise fastener openings 55. Preferably, the connection 1 additionally comprises fasteners 57 that pass through the fastener openings 55 in the first substantially planar side attachment portion 9 of the first side attachment member 8 and the substantially planar side attachment portion 9 of the second side attachment member 26 and into the supporting structural member 2. Preferably, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Preferably, the fasteners 57 that that pass through the fastener openings 55 in the first substantially planar side attachment portion 9 of the first side attachment member 8 and the substantially planar side attachment portion 9 of the second side attachment member 26 are masonry screw anchors 57, and the fasteners 58 that pass through the fastener openings 56 in the first and second substantially planar side attachment portions 6 and 22 of the cap 5 are self-drilling wood screws 58.

Figure 4:
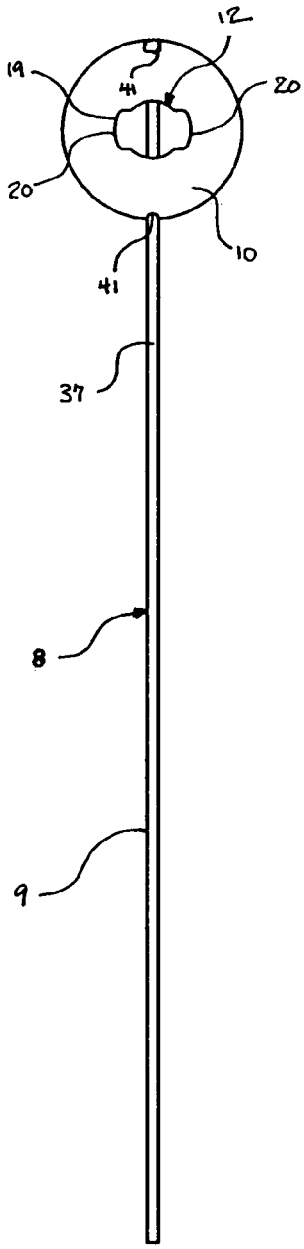
FIG. 4 is another side elevation view of an embodiment of the side attachment member of the connector of the present invention in which the connection portion is welded to the edge of the substantially planar attachment portion.
Figure 5:
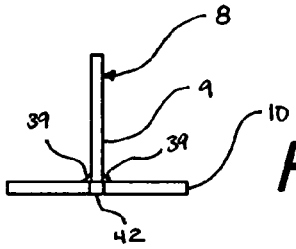
FIG. 5 is an end elevation view of an embodiment of the side attachment member of the connector of the present invention in which the connection portion is welded to the edge of the substantially planar attachment portion.
Figure 6:
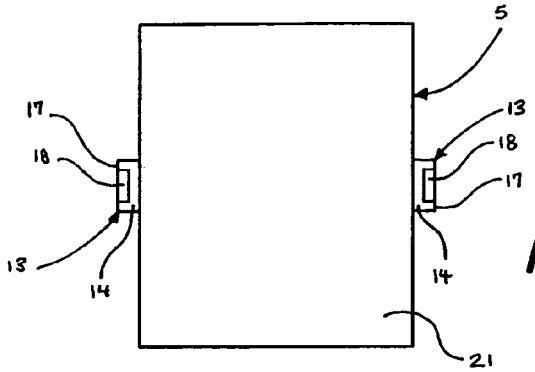
FIG. 6 is a top plan view of an embodiment of the cap of the connector of the present invention in which the cap has two substantially planar side attachment members joined by a substantially planar top attachment portion and two fixed pins with restraint extensions in the form of twin lobes.

Preferably, the first end 16 of the first pin 13 is welded to the cap 5, and the first end 16 of the second pin 13 is welded to the cap 5 with a circumferential fillet weld 39. Preferably, the connection portion 10 of the first side attachment member 8 is welded to the edge 37, and the connection portion 10 of the second side attachment member 26 is welded to the edge 37 with a pair of fillet welds 39. As shown in FIG. 3, the edge 37 to which the connection portion 10 is welded has an indentation 40 between the fillet welds 39 that attach the connection portion 10. Preferably, as shown in FIG. 4, the connection portion 10 has a pair of opposed notches 41 on its circumference that act as visual indicia for correct alignment when welding the connection portion 10 to the substantially planar attachment portion 9. As shown in FIG. 5, the substantially planar attachment portion includes a small peg 42 that projects from the edge 37 to interlock with one of the notches 41 and provide further assistance in aligning the connection portion 10. Preferably, the connector 4 is painted.

Figure 46:
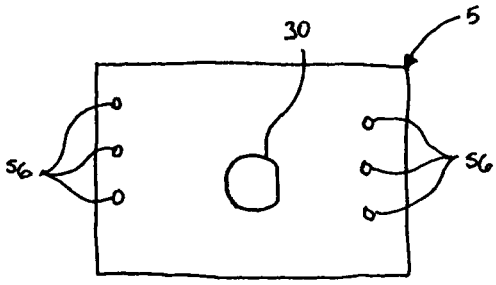
FIG. 46 is a side elevation view of the an embodiment of the cap of the connector of the present invention showing the D-shaped fixture opening before the pin is inserted and fixed.

Preferably, the substantially planar attachment portions 9 of the first and second side attachment members 8 and 26 are 24 3/16" from the centerlines of the pins 13 to the short edge 37 furthest away from the connection portion 10. Preferably, as shown in FIGS. 1A-1D, 3, 10, 11, 16, 19, 20 and 23, the substantially planar attachment portions 9 each have four fastener openings 55, and preferably only two of each set of four is used. The most preferred fasteners 57 for attaching to the supporting structural member 2 are Simpson Strong-Tie TITEN HD masonry screw anchors 57. If the supporting structural member 2 is a wood wall 2, the most preferred fasteners 57 would be a greater plurality of Simpson Strong-Tie Strong Drive SDS self-drilling wood screws. Preferably, the clearance diameter of the pin openings 12 is 1.344" and the outer diameter of the connection portion 10 is 4.210". The pins 13 are preferably machined from 1¾" Grade 36 diameter hot rolled bar stock with CNC lathes and machining centers. The first ends 16 of the pins 13 preferably have a D-shaped circumference and, as shown in FIG. 46, are inserted in D-shaped fixture openings 30 in the first and second substantially planar side attachment portions 6 and 22 of the cap 5. The pins 13 are then preferably welded in those fixture openings 30 with circumferential fillet welds 39. The cap 5 is preferably fastened to the supported structural member 3 with twelve fasteners 58, preferably self-driving wood screws 58, most preferably Simpson Strong-Tie Strong Drive SDS ¼" screws, 3" long if the supporting structural member 3 is sufficiently wide. If the first and second substantially planar side attachment portions 6 and 22 of the cap 5 are two separate plates 6 and 22 attached to the sides 53 of the supported structural member 3, as is preferred for retrofit installations, the plates 6 and 22 are preferably attached with eighteen fasteners 58, preferably self-driving wood screws 58, most preferably Simpson Strong-Tie Strong Drive SDS ¼×3 screws. The cap 5 is preferably made in several widths for double, triple, quadruple and quintuple-ply trusses 3, 3.5", 5.062", 7.25" and 8.312" wide respectively. Preferably, the cap 5 and first and second side attachment members 8 and 26 are formed from 3 gauge Grade 33 hot rolled steel.

FOURTH PREFERRED EMBODIMENT

In the fourth preferred embodiment, the first pins 13 are fixedly attached to the first and second side attachment members 8 and 26 and the first pin openings 12 are in the cap 5. As with the second preferred embodiment, this particular arrangement, according to which the first pin 13 is fixedly attached to the first side attachment member 8, is similar to fixedly attaching the first pin 13 to the cap 5 and is, therefore, not shown in the drawings. This is less preferred than attaching the first pins 13 to the cap member 5, but it would be a functional alternative. Preferably, the first pin 13 is fixedly attached to the first side attachment member 8 and the first pin opening 12 is in the cap 5, and the second pin 13 is fixedly attached to the second side attachment member 26 and the second pin opening 12 is in the cap 5. Preferably, the first restraint extension 18 on the first pin 13 is one or more lobes 18 that extend beyond the circumference 15 of the body 14 and the circumference 19 of the first pin opening 12. Preferably, the first restraint extension 18 on the second pin 13 is one or more lobes 18 that extend beyond the circumference 15 of the body 14 and the circumference 19 of the second pin opening 12. Preferably, the first pin opening 12 has one or more open lobes 20 that extend beyond the circumference 19 of the first pin opening 12. Preferably, the fixedly attached first pin 13 is inserted through the first pin opening 12 in an orientation that permits the one or more lobes 18 on the first pin 13 to pass through the one or more open lobes 20 of the first pin opening 12, and the cap 5 and the first side attachment member 8 are then rotated on the first pin connection 11 so that the one or more lobes 18 on the first pin 13 no longer match the one or more open lobes 20 of the first pin opening 12, thereby restraining the cap 5 and the first side attachment member 8 from being separated at the first pin connection 11. Preferably, the second pin opening 12 has one or more open lobes 20 that extend beyond the circumference 19 of the second pin opening 12. The fixedly attached second pin 13 is preferably inserted through the second pin opening 12 in an orientation that permits the one or more lobes 18 on the second pin 13 to pass through the one or more open lobes 20 of the second pin opening 12, and the cap 5 and the second side attachment member 26 are then rotated on the second pin connection 29 so that the one or more lobes 18 on the second pin 13 no longer match the one or more open lobes 20 of the second pin opening 12, thereby restraining the cap 5 and the second side attachment member 26 from being separated at the first pin connection 29.

Preferably, the cap 5 additionally comprises a substantially planar top attachment portion 21 that interfaces with the supported structural member 3. Preferably, the second substantially planar side attachment portion 22 of the cap 5 is attached to the substantially planar top attachment portion 21. Preferably, the first side attachment member 8 additionally comprises an edge 37 on said substantially planar attachment portion 9 and the connection portion 10 of the first side attachment member 8 is attached to the edge 37. Preferably, the second side attachment member 26 additionally comprise an edge 37 and the connection portion 10 of the second side attachment member 26 is attached to the edge 37.

Preferably, the substantially planar side attachment portion 9 of the first side attachment member 8 and the substantially planar side attachment portion 9 of the second side attachment member 26 additionally comprise fastener openings 55. Preferably, the connection 1 additionally comprises fasteners 57 that pass through the fastener openings 55 in the first substantially planar side attachment portion 9 of the first side attachment member 8 and the substantially planar side attachment portion 9 of the second side attachment member 26 and into the supporting structural member 2. Preferably, the first and second substantially planar side attachment portions 6 and 22 of the cap 5 additionally comprise fastener openings 56, Preferably, the connection 1 additionally comprises fasteners 58 that pass through the fastener openings 56 in the first and second substantially planar side attachment portions 6 and 22 of the cap 5 and into the supported structural member 3. Preferably, the fasteners 57 that that pass through the fastener openings 55 in the first substantially planar side attachment portion 9 of the first side attachment member 8 and the substantially planar side attachment portion 9 of the second side attachment member 26 are masonry screw anchors 57. Preferably, the fasteners 58 that pass through the fastener openings 56 in the first and second substantially planar side attachment portions 6 and 22 of the cap 5 are self-drilling wood screws 58.

Preferably, the first end 16 of the first pin 13 is welded to the first side attachment member 8, and the first end 16 of the second pin 13 is welded to the second side attachment member 26. The connection portion 10 of the first side attachment member 8 is preferably welded to the edge 37, and the connection portion 10 of the second side attachment member 26 is preferably welded to the edge 37. Preferably, the connector 4 is painted.

FIFTH PREFERRED EMBODIMENT

As shown in FIGS. 29, 34-37 and 28B, in the fifth preferred embodiment the first pin opening 12 is preferably in the cap 5, the first attachment member 8 additionally comprises a second pin opening 12 and the first pin 13 passes through the second pin opening 12, and the first pin 13 additionally comprises a second restraint extension 18 that extends beyond the circumference 15 of the body 14. The pin openings 12 in the cap 5 and the first attachment member 8 preferably face each other side-by-side. Preferably, the second pin opening 12 has a circumference 19, and the second restraint extension 18 extends beyond the circumference 19 of the second pin opening 12, preventing the first pin 13 from withdrawing from the second pin opening 12.

Preferably, the first restraint extension 18 is a circumferential flange 18 that extends beyond the circumference 15 of the body 14 and the circumference 19 of the first pin opening 12. The second restraint extension 18 is a circumferential flange 18 that extends beyond the circumference 15 of the body 14 and the circumference 19 of the second pin opening 12. In this form, the cap member 5 and the first side attachment member 8 cannot be separated without disassembling the pin 13 itself, which is not possible in the preferred form of the pin 13, which is a rivet.

Preferably, the cap 5 additionally comprises a substantially planar top attachment portion 21 that interfaces with the supported structural member 3. Preferably, the cap 5 additionally comprises a second substantially planar side attachment portion 22 that interfaces with the supported structural member 3.

Figure 29:
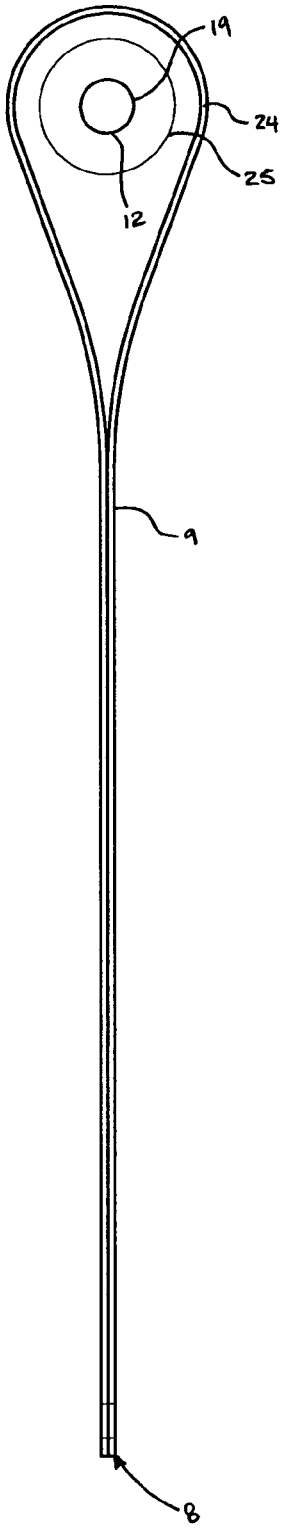
FIG. 29 is a side elevation view of a first side attachment member that is formed by bending a V-shaped strap to form a two-ply substantially planar attachment portion and a connection portion, with a reinforcing embossment around the pin opening, from the middle of the V-shaped strap.
Figure 34:
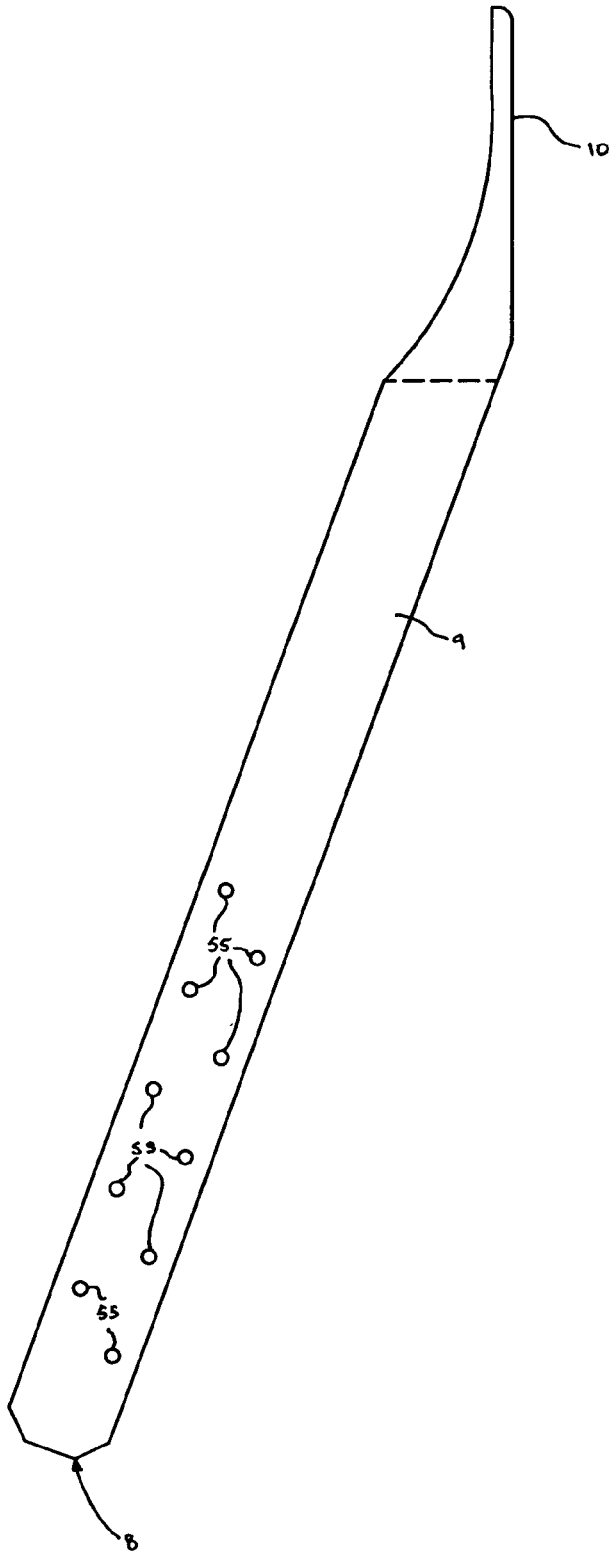
FIG. 34 is a front elevation view of a first side attachment member that is formed by bending a V-shaped strap to form a two-ply substantially planar attachment portion and a connection portion, with a reinforcing embossment around the pin opening, from the middle of the V-shaped strap.
Figure 33:
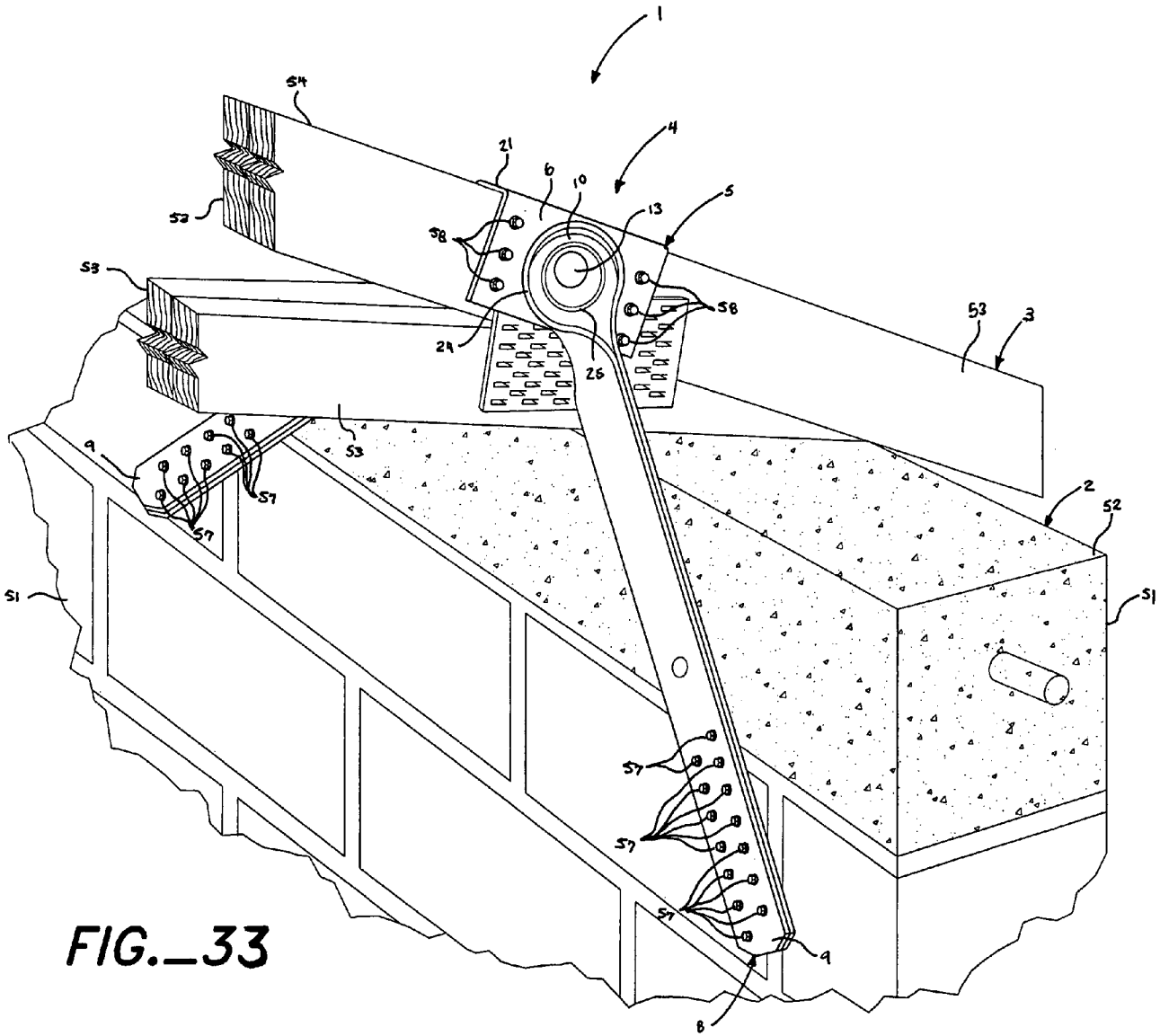
FIG. 33 is a perspective view of a concrete masonry wall, with a concrete tie beam surmounting the wall, supporting a pitched girder truss that is orthogonal to the wall and overhangs the outer side of the wall, and a two-sided form of the connector of the present invention that has first side attachment members that are formed by bending a V-shaped strap to form two-ply substantially planar attachment portions and connection portions, with reinforcing embossments around the pin openings, from the middle of the V-shaped strap.
Figure 35:
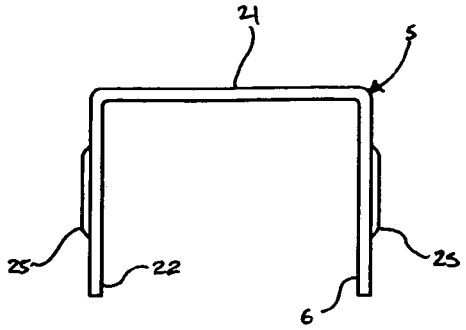
FIG. 35 is a front elevation view of an embodiment of the cap of the connector of the present invention in which the cap has two substantially planar side attachment members joined by a substantially planar top attachment portion and two pin openings.
Figure 36:
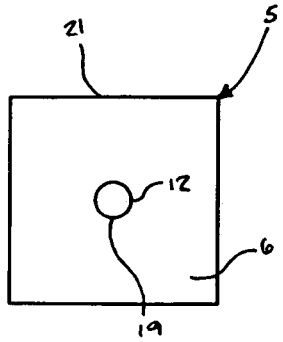
FIG. 36 is a side elevation view of an embodiment of the cap of the connector of the present invention in which the cap has two substantially planar side attachment members joined by a substantially planar top attachment portion and two pin openings.
Figure 37:
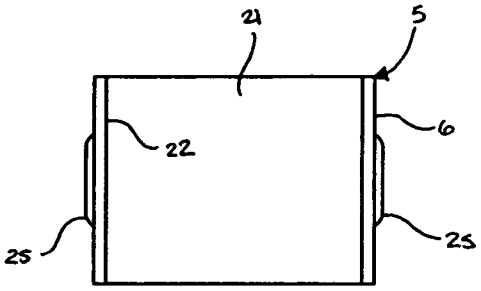
FIG. 37 is a bottom plan view of an embodiment of the cap of the connector of the present invention in which the cap has two substantially planar side attachment members joined by a substantially planar top attachment portion and pin openings.

Preferably, as shown in FIG. 29, the connection portion 10 of the first side attachment member 8 additionally comprises a reinforcing embossment 25 around the first pin opening 12 in the first side attachment member 8. The embossment 25 reinforces the first pin opening 12 by stiffening the material around the first pin opening 12. Preferably, the first substantially planar side attachment portion 6 of the cap 5 additionally comprises a reinforcing embossment 25 around the second pin opening 12 that matches the reinforcing embossment 25 around the first pin opening 12 in the first side attachment member 8 so that the reinforcing embossment 25 and the reinforcing embossment 25 fit together and transmit bearing forces between the cap 5 and the first side attachment member 8. The reinforcing embossments 25 are shown in FIGS. 35-37, 38B and 40.

Figure 39:
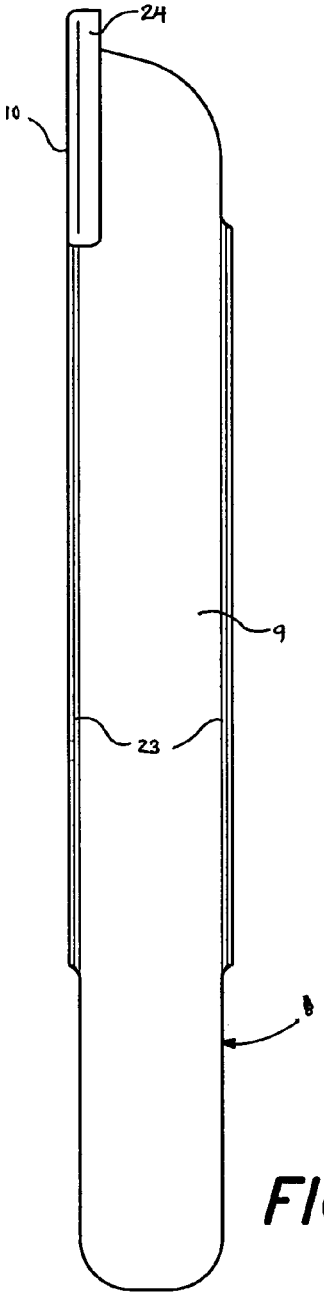
FIG. 39 is a front elevation view of a first side attachment member that is formed with reinforcing flanges and a reinforcing embossment around the pin opening.
Figure 40:
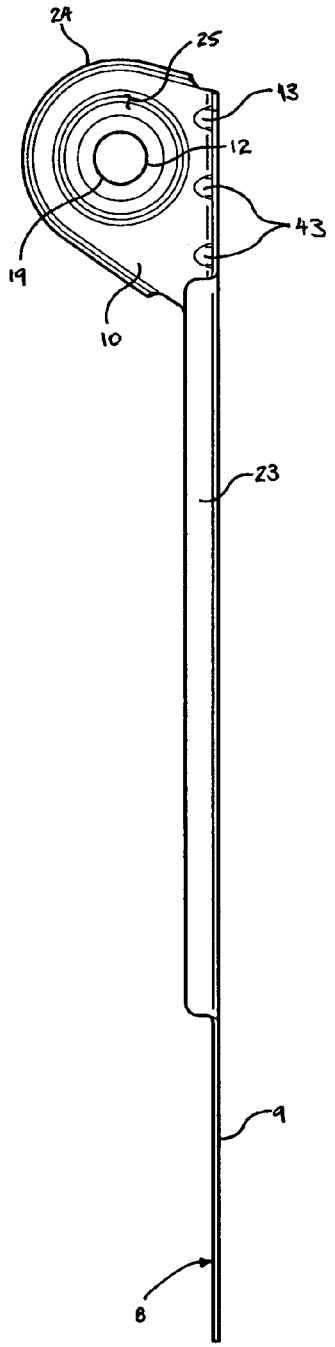
FIG. 40 is a side elevation view of a first side attachment member that is formed with reinforcing flanges and a reinforcing embossment around the pin opening.
Figure 41:
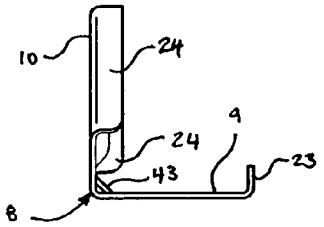
FIG. 41 is an end elevation view of an embodiment of the side attachment member of the connector of the present invention in which the connection portion and the substantially planar attachment portion are both formed with reinforcing flanges and the connection portion is formed with a reinforcing embossment around the pin opening.
Figure 42:
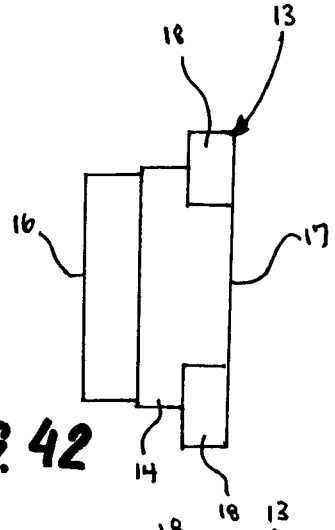
FIG. 42 is a side elevation view of an embodiment of the fixed pin of the present invention.
Figure 44:
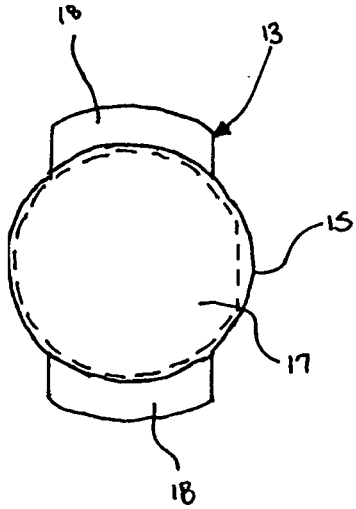
FIG. 44 is a top plan view of an embodiment of the fixed pin of the present invention, showing the D-shape of the first end of the pin in dotted line, but not showing all three diameters of the preferred embodiment because they are too close to be shown fully separated.
Figure 43:
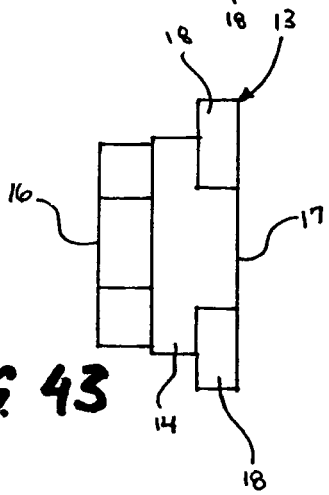
FIG. 43 is an opposite side elevation view of an embodiment of the fixed pin of the present invention.
Figure 45:
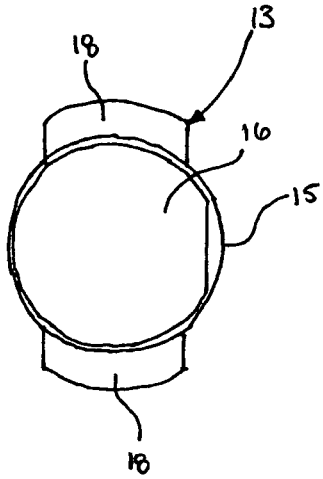
FIG. 45 is a bottom plan view of an embodiment of the fixed pin of the present invention, showing the D-shape of the first end of the pin, but not showing all three diameters of the preferred embodiment because they are too close to be shown fully separated.

Preferably, the substantially planar attachment portion 9 of the first side attachment member 8 additionally comprises a reinforcing flange 23. Preferably, the connection portion 10 of the first side attachment member 8 additionally comprises a reinforcing flange 24. The reinforcing flanges 23 and 24 are shown in FIGS. 39-41. The embossments 25 and the reinforcing flanges 23 and 24 are particularly important when the connector 4 is made of lighter gauge sheet steel. The heavier gauge steel of the welded and painted forms of the connector 4 do not require the embossments 25 and reinforcing flanges 23 and 24.

Figure 38B:
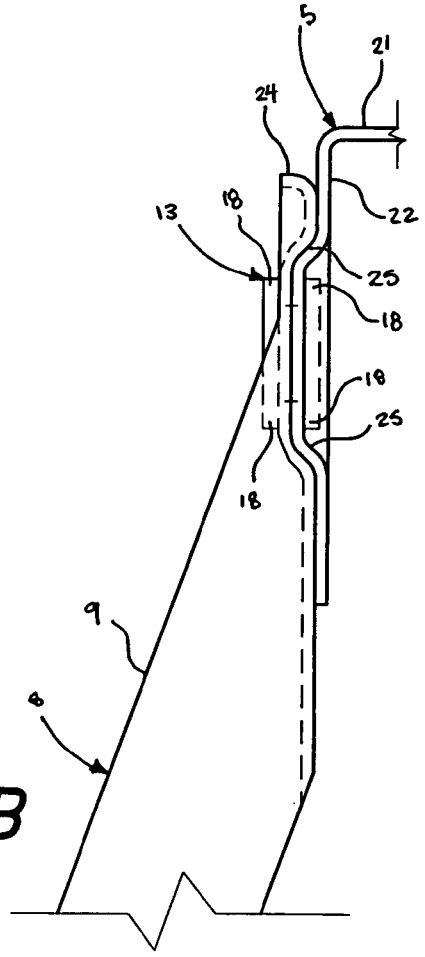
FIG. 38B is an end view of an embodiment of the pin connection showing matching embossments in the cap and side attachment member and a reinforcing flange in the side attachment member.

Preferably, as shown in FIG. 38B, the first pin 13 is a rivet. The first pin 13 could also be made as a press fit part, but the restraint extensions 18 of a rivet are stronger.

Figure 38A:
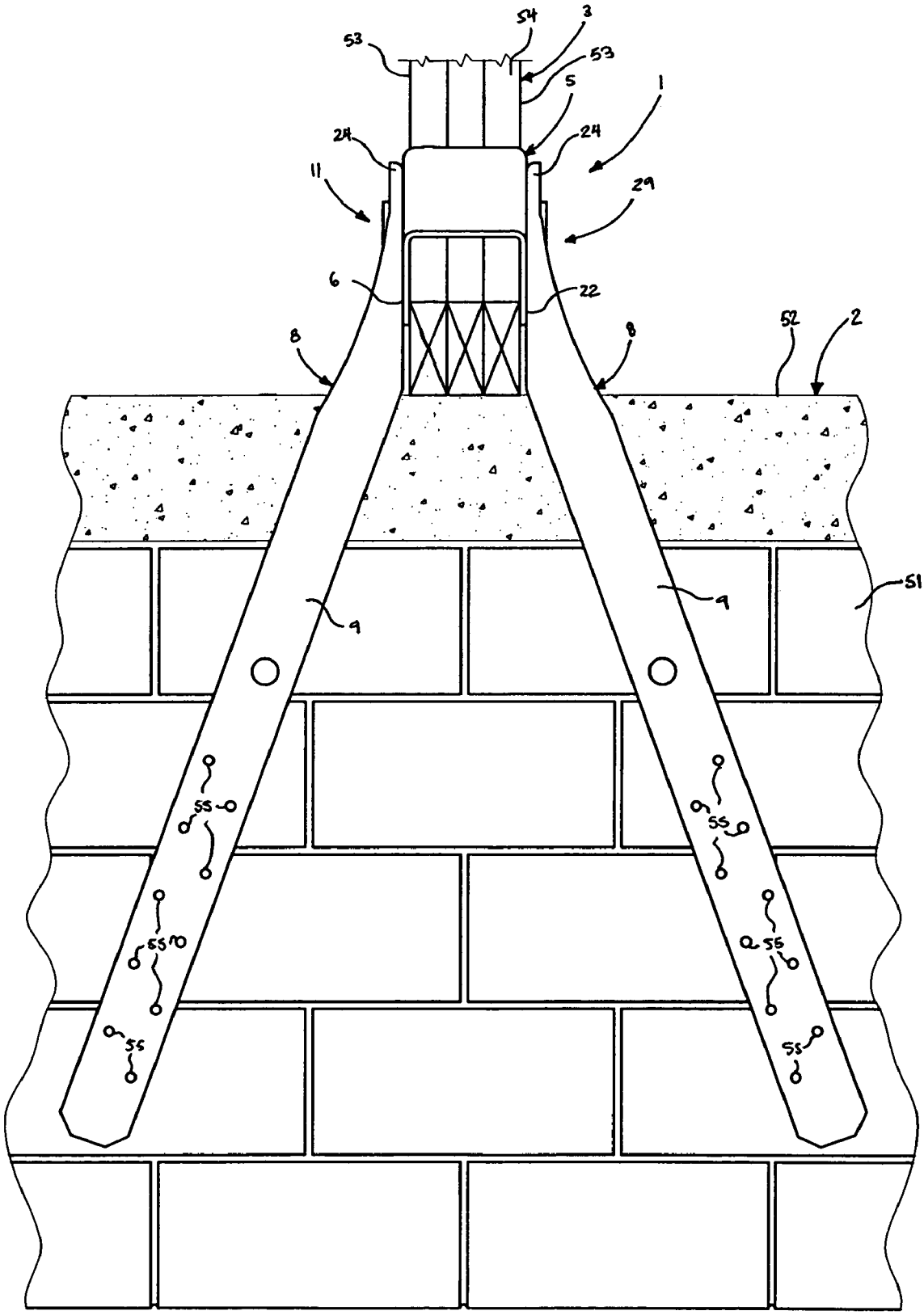
FIG. 38A an elevation view of the outer side of a concrete masonry wall, with a concrete tie beam surmounting the wall, supporting a pitched girder truss that is orthogonal to the wall, and a two-sided form of the connector of the present invention that has first side attachment members that are formed by bending a V-shaped strap to form two-ply substantially planar attachment portions and connection portions, with reinforcing embossments around the pin openings, from the middle of the V-shaped strap.

Preferably, as shown in FIG. 38A, the substantially planar side attachment portion 9 of the first side attachment member 8 additionally comprises fastener openings 55, and the connection 1 additionally comprises fasteners 57 that pass through the fastener openings 55 in the first substantially planar side attachment portion 9 of the first side attachment member 8 and into the supporting structural member 2. Preferably, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Preferably, the fasteners 57 that pass through the fastener openings 55 in the first substantially planar side attachment portion 9 of the first side attachment member 8 are masonry screw anchors 57, and the fasteners 58 that pass through the fastener openings 56 in the first and second substantially planar side attachment portions 6 and 22 of the cap 5 are self-drilling wood screws 58.

SIXTH PREFERRED EMBODIMENT

As shown in FIG. 38A, the sixth preferred embodiment is essentially the same as the fifth preferred embodiment, except that it is double-sided. The preferred side attachment member 8 or 26 is shown FIGS. 29 and 24, but other side attachment members 8 or 26 could be used, including those shown in FIGS. 39-4. The cap member 5 additionally comprises a second substantially planar side attachment portion 22 that interfaces with the supported structural member 3. The connector additionally comprises a second side attachment member 26 comprising a substantially planar attachment portion 9 that interfaces with and is fastened to the supporting structural member 2, and a connection portion 10 that is positioned alongside said second substantially planar side attachment portion 22 of said cap 5. Preferably, a second pin connection 29 that enables rotation between the second side attachment member 26 and the cap 5. The second pin connection 29 preferably further comprises a third pin opening 12 in the cap 5 and a fourth pin opening 12 in the second side attachment member 26, and a second pin 13 that passes through the third pin opening 12 and the fourth pin opening 12. Preferably, the second pin 13 comprises a body 14 having a circumference 15, a first end 16 with a second restraint extension 18 that extend beyond the circumference 19, and a second end 17 with a first restraint extension 18 that extends beyond the circumference 15 of the body 14. The third pin opening 12 preferably has a circumference 19 and the fourth pin opening 12 has a circumference 19. Preferably, the first restraint extension 18 of the second pin 13 extends beyond the circumference 19 of the third pin opening 12, preventing the second pin 13 from withdrawing from the third pin opening 12. The second restraint extension 18 of the second pin 13 preferably extends beyond the circumference 19 of the fourth pin opening 12, preventing the second pin 13 from withdrawing from the fourth pin opening 12.

Preferably, the first restraint extension 18 of the first pin 13 is a circumferential flange 18 that extends beyond the circumference 15 of the body 14. The second restraint extension 18 of the first pin 13 preferably is a circumferential flange 18 that extends beyond the circumference 15 of the body 14, and the first restraint extension 18 of the first pin 13 is a circumferential flange 18 that extends beyond the circumference 15 of the body 14. Preferably, the second restraint extension 18 of the first pin 13 is a circumferential flange 18 that extends beyond the circumference 15 of the body 14.

As previously described, preferably the cap 5 additionally comprises a substantially planar top attachment portion 21 that interfaces with the supported structural member 3. Preferably, the cap 5 additionally comprises a second substantially planar side attachment portion 22 that interfaces with the supported structural member 3. Preferably, the connection portion 10 of the first side attachment member 8 additionally comprises a reinforcing embossment 25 around the second pin opening 12 in the first side attachment member 8. Preferably, the connection portion 10 of the second side attachment member 9 additionally comprises a reinforcing embossment 25 around the fourth pin opening 12 in the second side attachment member 9. Preferably, the first substantially planar side attachment portion 6 of the cap 5 additionally comprises a reinforcing embossment 25 around the first pin opening 12 that matches the reinforcing embossment 25 around the second pin opening 12 in the first side attachment member 8 so that the reinforcing embossment 25 in the first substantially planar side attachment portion 6 and the reinforcing embossment 25 fit together and transmit bearing forces between the cap 5 and the first side attachment member 8. Preferably, the second substantially planar side attachment portion 22 of the cap 5 additionally comprises a reinforcing embossment 25 around the third pin opening 12 that matches the reinforcing embossment 25 around the fourth pin opening 12 in the second side attachment member 26 so that the reinforcing embossment 25 in the second substantially planar side attachment portion 22 and the reinforcing embossment 25 in the second side attachment member 26 fit together and transmit bearing forces between the cap 5 and the second side attachment member 26.

Preferably, the first pin 13 is a rivet, and the second pin 13 is a rivet.

Preferably, the substantially planar side attachment portion 9 of the first side attachment member 8 and the substantially planar side attachment portion 9 of the second side attachment member 26 additionally comprise fastener openings 55. Preferably, the connection 1 additionally comprises fasteners 57 that pass through the fastener openings 55 in the first substantially planar side attachment portion 9 of the first side attachment member 8 and the substantially planar side attachment portion 9 of the second side attachment member 26 and into the supporting structural member 2. Preferably, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Preferably, the fasteners 57 that that pass through the fastener openings 55 in the first substantially planar side attachment portion 9 of the first side attachment member 8 and the substantially planar side attachment portion 9 of the second side attachment member 26 are masonry screw anchors 57. Preferably, the fasteners 58 that pass through the fastener openings 56 in the first and second substantially planar side attachment portions 6 and 22 of the cap 5 are self-drilling wood screws 58.

As described above, the sixth preferred embodiment of the invention can be used with a variety of side members 8 and 26. The following is a description of the use of the side members 8 and 26 shown in FIGS. 39-41. The substantially planar attachment portion 9 of the first side attachment member 8 additionally comprises a reinforcing flange 23, and the substantially planar attachment portion 9 of the second side attachment member 26 additionally comprises a reinforcing flange 23. Preferably, the connection portion 10 of the first side attachment member 8 additionally comprises a reinforcing flange 24, and the connection portion 10 of the second side attachment member 9 additionally comprises a reinforcing flange 24.

Figure 25:
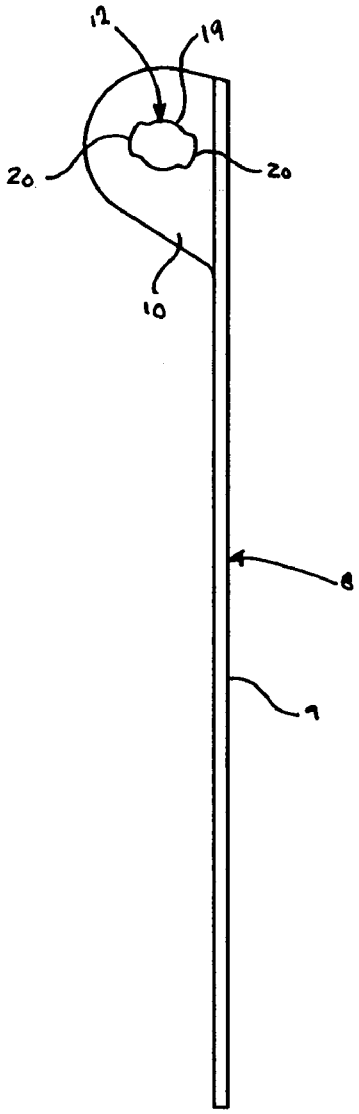
FIG. 25 is a side elevation view of an embodiment of the side attachment member of the connector of the present invention in which the connection portion is orthogonally joined to the edge of the substantially planar attachment portion.
Figure 26:
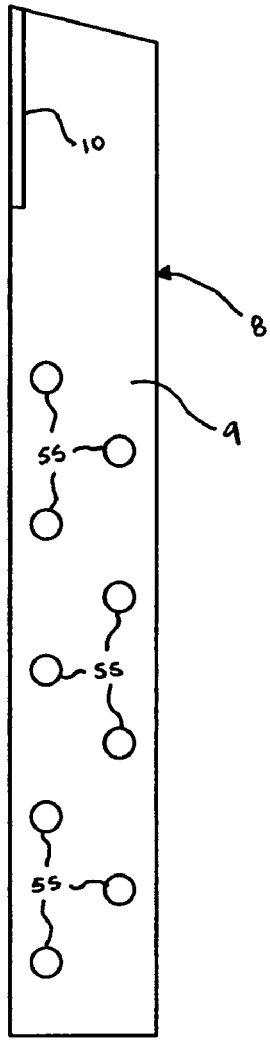
FIG. 26 is a front elevation view of an embodiment of the side attachment member of the connector of the present invention in which the connection portion is orthogonally joined to the edge of the substantially planar attachment portion.
Figure 27:
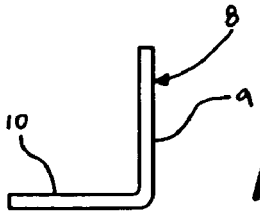
FIG. 27 is an end elevation view of an embodiment of the side attachment member of the connector of the present invention in which the connection portion is orthogonally joined to the edge of the substantially planar attachment portion.
Figure 28:
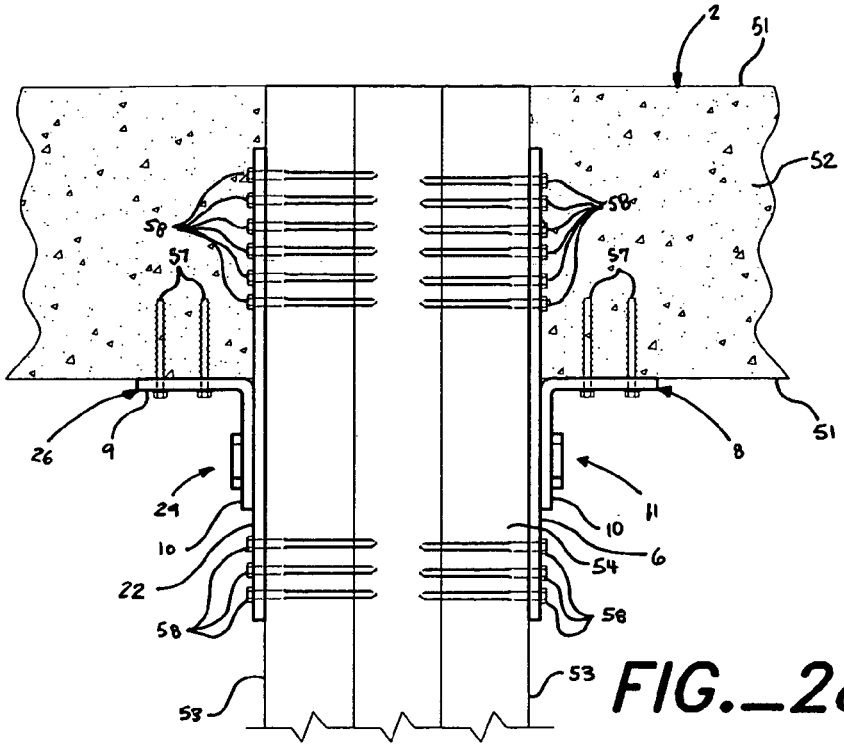
FIG. 28 is a top plan view of the connection of the present invention with a cap that has two separate substantially planar side attachment members and two fixed pins with restraint extensions in the form of twin lobes and two side attachment members of the connector of the present invention in which the connection portion is orthogonally joined to the edge of the substantially planar attachment portion.
Figure 30:
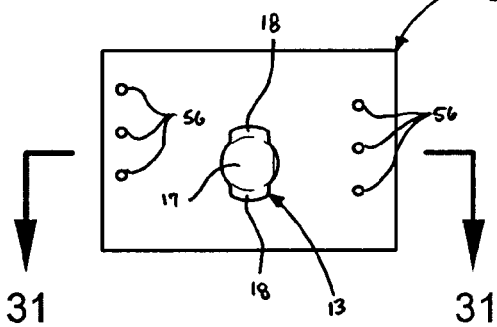
FIG. 30 is a side elevation view of an embodiment of the cap of the connector of the present invention in which the cap has two substantially planar side attachment members joined by a substantially planar top attachment portion and showing the fixed pin in detail.
Figure 31:
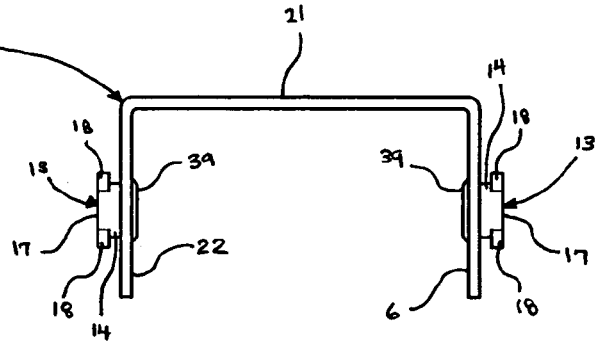
FIG. 31 is a front elevation view of an embodiment of the cap of the connector of the present invention in which the cap has two substantially planar side attachment members joined by a substantially planar top attachment portion and showing the fixed pin in detail.

Preferably, the first and second side attachment members 8 and 26 are 25" long and 4" wide. Preferably, they are each attached to the supporting structural member 2 with 5 fasteners 57, preferably masonry screw anchors 57, most preferably ⅝" diameter×6" long Simpson Strong-Tie TITEN HD anchors. As shown in FIGS. 39-41, the connection portions 10 are preferably bent out of the material of the first and second side attachment members 8 and 26 so that they are orthogonal to the substantially planar attachment portions 9, forming a P-shape in which the head of the P is the connection portion 10 and the leg of the P is the substantially planar attachment portion 9. FIGS. 25-27 show a P-shaped first or second side attachment member 8 or 26, in which the head of the P is the connection portion 10 and the leg of the P is the substantially planar attachment portion 9, but the embodiment shown in FIGS. 25-27 is used with a fixed pin 13 attached to the cap 5. As shown in FIGS. 39-41, the juncture between the head and leg of the P in this P-shaped embodiment is preferably reinforced with gussets 43. The connection portion 10 is preferably is 3.76" in diameter. Preferably, the first and second side attachment members 8 and 26 and the cap 5 are all formed from 12 gauge (0.1" thick) galvanized sheet steel. The reinforcing flanges 23 of the first and second side attachment members 8 and 26 are preferably on both the substantially planar attachment portions 9 and the connection portions 10, as shown in FIGS. 39-41, and are preferably ⅞" high. The pin openings 12 are preferably 1" in diameter and the pins 13 themselves are preferably 1" diameter rivets 13. The reinforcing embossments 25 around the pin openings 12 in the cap 5 and the first and second side attachment members 8 and 26 are preferably ¼" deep.

SEVENTH PREFERRED EMBODIMENT

The seventh preferred embodiment is shown in FIGS. 29, 34, 35-37, 38A and 38B. In it, the first side attachment member 8 is formed by bending a V-shaped length of steel in half to form a two-ply substantially planar attachment portion 9 and a connection portion 10 that joins the plies. The apex of the V is formed with a teardrop shape (that becomes the connection portion 10) and the straps (which become the substantially planar attachment portion 9) branch out at a narrow angle that allows them to be folded together to form a single substantially planar attachment portion 9.

Preferably, the substantially planar side attachment portion 9 of the first side attachment member 8 additionally comprises fastener openings 55, and the connection 1 additionally comprises fasteners 57 that pass through the fastener openings 55 in the first substantially planar side attachment portion 9 of the first side attachment member 8 and into the supporting structural member 2. Preferably, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Preferably, the fasteners 57 that that pass through the fastener openings 55 in the first substantially planar side attachment portion 9 of the first side attachment member 8 are masonry screw anchors 57, and the fasteners 58 that pass through the fastener openings 56 in the first and second substantially planar side attachment portions 6 and 22 of the cap 5 are self-drilling wood screws 58.

EIGHTH PREFERRED EMBODIMENT

The eighth preferred embodiment is essentially the same as the seventh preferred embodiment, except that it is double-sided. In it, the first side attachment member 8 is formed by bending a V-shaped length of steel in half to form a two-ply substantially planar attachment portion 9 and a connection portion 10 that joins the plies. The second side attachment member 26 is also formed by bending a V-shaped length of steel in half to form a two-ply substantially planar attachment portion 9 and a connection portion 10 that joins the plies.

Preferably, the substantially planar side attachment portion 9 of the first side attachment member 8 and the substantially planar side attachment portion 9 of the second side attachment member 26 additionally comprise fastener openings 55. Preferably, the connection 1 additionally comprises fasteners 57 that pass through the fastener openings 55 in the first substantially planar side attachment portion 9 of the first side attachment member 8 and the substantially planar side attachment portion 9 of the second side attachment member 26 and into the supporting structural member 2. Preferably, the first and second substantially planar side attachment portions 6 and 22 of the cap 5 additionally comprise fastener openings 56, and the connection 1 additionally comprises fasteners 58 that pass through the fastener openings 56 in the first and second substantially planar side attachment portions 6 and 22 of the cap 5 and into the supported structural member 3. Preferably, the fasteners 57 that that pass through the fastener openings 55 in the first substantially planar side attachment portion 9 of the first side attachment member 8 and the substantially planar side attachment portion 9 of the second side attachment member 26 are masonry screw anchors 57. Preferably, the fasteners 58 that pass through the fastener openings 56 in the first and second substantially planar side attachment portions 6 and 22 of the cap 5 are self-drilling wood screws 58.

Preferably, the first and second side attachment members 8 and 26 are 22⅛" long and 2" wide. Preferably, they are each attached to the supporting structural member 2 with 5 fasteners 57, preferably masonry screw anchors 57, most preferably ½" diameter×6" long Simpson Strong-Tie TITEN HD anchors. Preferably, the connection portion 10 is 3¾" in diameter. Preferably, the first and second side attachment members 8 and 26 and the cap 5 are all formed from 10 gauge (0.135" thick) galvanized sheet steel. Preferably, the connection portions 10 are canted 10 degrees out of line from the substantially planar attachment portions 9 of the first and second side attachment member 8 and 26, so that the substantially planar side attachment portions 9 angle outward from the supported structural member 3, as shown in FIG. 38A. As shown in FIGS. 29, 24 and 38B and 38B, the reinforcing flanges 23 of the first and second side attachment members 8 and 26 extend between the connection portion 10 and the substantially planar attachment portion 9 and are preferably 0.38" high in the connection portion 10. The pin openings 12 are preferably 1" in diameter and the pins 13 themselves are preferably 1" diameter rivets 13.

In retrofit or new construction application using caps 5 that have no substantially planar top attachment portion 21 and only a first substantially planar side attachment portion 6 or only first and second substantially planar side attachment portions 6 and 22, the first side attachment member 8 or the first and second side attachment members 8 and 26, if there are two, are first connected to the cap 5, if they have detachable pins 13. Second, the substantially planar side attachment portions 6 and 22 are aligned so that they are flush with the top 54 of the truss 3 and the first and second side attachment members 8 and 26 are vertical and in contact with the side 51 of the wall 2. Third, the substantially planar side attachment portions 6 and 22 are attached to the truss 3 with fasteners 58 and the first and second side attachment members 8 and 26 are attached to the wall with fasteners 57.

In new construction application using caps 5 that have a substantially planar top attachment portion 21, the first and second side attachment members 8 and 26, are first connected to the cap 5, if they have detachable pins 13. Second, the substantially planar top attachment portion 21 of the cap 5 is placed on the top 54 of the truss 3, which aligns the substantially planar side attachment portions 6 and 22 so that they are flush with the top 54 of the truss 3 and the first and second side attachment members 8 and 26 are vertical and in contact with the side 51 of the wall 2. Third, the substantially planar side attachment portions 6 and 22 are attached to the truss 3 with fasteners 58 and the first and second side attachment members 8 and 26 are attached to the wall with fasteners 57.

Generally, only caps 5 without substantially planar top attachment portions 21 will be used in retrofit applications because substantially planar top attachment portions 21 would interfere with roof sheathing on top of the trusses 3. If there is enough space between any roof sheathing and the tops 54 of the trusses 3, L-shaped caps 5 with only a first substantially planar side attachment portion 6 and a substantially planar top attachment portion 21 could be used by sliding the substantially planar top attachment portion 21 between the top 54 of the truss 3 and the roof sheathing. If there is no roof sheathing, as in new construction, caps 5 with first and second substantially planar side attachment portions 6 and 22 and a substantially planar top attachment portion 21 can be used and are preferable because they require fewer fasteners 58 to attach them to the truss 3 since the substantially planar top attachment portion 21 primarily holds down the truss 3.

MOST PREFERRED EMBODIMENTS

There are three most preferred embodiments. The first is shown in FIGS. 11-16), the second in FIG. 18, and the third in FIGS. 19-23. These are suitable for both retrofit and new construction, having caps 5 that have a separate first substantially planar side attachment portion 6 and a separate second substantially planar side attachment portion 22, and no connecting substantially planar top attachment portion 21 which can interfere with roof sheathing.

We claim:

1. A connection (1) comprising:

a. an elongate substantially vertical supporting structural member (2), further comprising two sides (51) and a top (52), supporting an elongate generally horizontal supported structural member (3), further comprising two sides (53) and a top (54), that is not parallel to said elongate substantially vertical supporting member (2), said supported structural member (3) bearing on said top (52) of said supporting structural member (2);

b. a connector (4) comprising:

i. a cap (5), connected to said supported structural member (3), comprising a first substantially planar side attachment portion (6) that interfaces with said supported structural member (3);

ii. a first side attachment member (8) comprising a substantially planar attachment portion (9) lying in a first plane and a connecting portion (10) comprising a plate attached to the planar attachment portion (9), lying in a second plane, wherein the second plane is not in the same plane as the first plane, the attachment portion (9) interfaces with and is fastened to one of said two sides (51) of said supporting structural member (2) with separate fasteners (55), said substantially planar attachment portion (9) being at an angle to said first substantially planar side attachment portion (6) of said cap (5) where said substantially planar attachment portion (9) is fastened to said supporting structural member (2), and the connection portion (10) is positioned alongside and at least partially parallel to said first substantially planar side attachment portion (6) of said cap (5);

iii. a first pin connection (11) generally perpendicular to said supported structural member (3) that enables rotation on an axis not generally perpendicular to said supporting structural member between said cap (5) and said first side attachment member (8), and that connects said cap (5) to said first attachment member (8), said cap rotating in a plane generally perpendicular to said supporting structural member; wherein said first pin connection (11) further comprises a first pin opening (12) in one of said cap (5) and said first side attachment member (8), and a first pin (13) that passes through said first pin opening (12), said first pin (13) comprises a body (14) having a circumference (15), a first end (16), and a second end (17), said first end (16) of said first pin (13) is fixedly attached to the other of said cap (5) and said first side attachment member (8) so that said first pin (13) cannot rotate within or withdraw from the other of said cap (5) and said first side attachment member (8) that does not have a first pin opening (12), said second end (17) of said fist pin (13) is formed with a first restraint extension (18) that extends beyond said circumference (15) of said body (14), and said first pin opening (12) has a circumference (19), and said first restraint extension (18) is one or more lobes (18) that extend beyond said circumference of said first pin opening (12), preventing said first pin (13) from withdrawing from said first pin opening (12), said first pin opening (12) has one or more open lobes (20) that extend beyond said circumference (19) of said first pin opening (12); and said fixedly attached first pin (13) is inserted through said first pin opening (12) in an orientation that permits said one or more lobes (18) on said first pin (13) to pass through said one or more open lobes (20) of said first pin opening (12), and said cap (5) and said first side attachment member (8) are then rotated on said first pin connection (11) so that said one or more lobes (18) on said first pin (13) no longer match said one or more open lobes (20) of said first pin opening (12), thereby restraining said cap (5) and said first side attachment member (8) from being separated at said first pin connection (11); wherein c. said connection (1) additionally comprises fasteners (58) that pass through said first substantially planar side attachment portions (6) of said cap (5) and into said supported structural member (3), at least some of said fasteners (58) being located on opposite sides of said first pin connection (11).

2. The connection of claim 1 wherein:

a. said first pin (13) is fixedly attached to said cap (5) and said first pin opening (12) is in said first side attachment member (8).

3. The connection of claim 2 wherein:

a. said cap (5) additionally comprises a substantially planar top attachment portion (21) that interfaces with said supported structural member (3).

4. The connection of claim 3 wherein:

a. said cap (5) additionally comprises a second substantially planar side attachment portion (22) that interfaces with said supported structural member (3).

5. The connection of claim 4 wherein:

a. said first side attachment member (8) additionally comprises an edge (37) on said substantially planar attachment portion (9) and said connection portion (10) of said first side attachment member (8) is attached to said edge (37).

6. The connection of claim 5 wherein:

a. said substantially planar side attachment portion (9) of said first side attachment member (8) additionally comprises fastener openings (55); and b. said connection (1) additionally comprises fasteners (57) that pass through said fastener openings (55) in said first substantially planar side attachment portion (9) of said first side attachment member (8) and into said supporting structural member (2).

7. The connection of claim 6 wherein:

a. said first and second substantially planar side attachment portions (6) and (22) of said cap (5) additionally comprise fastener openings (56).

8. The connection of claim 7 wherein:

a. said fasteners (57) that that pass through said fastener openings (55) in said first substantially planar side attachment portion (9) of said first side attachment member (8) are masonry screw anchors (57); and b. said fasteners (58) that pass through said fastener openings (56) in said first and second substantially planar side attachment portions (6) and (22) of said cap (5) are self-drilling wood screws (58).

9. The connection of claim 8 wherein:

a. said first end (16) of said first pin (13) is welded to said cap (5).

10. The connection of claim 9 wherein:

a. said connection portion 10 of said first side attachment member (8) is welded to said edge (37).

11. The connection of claim 10 wherein:

a. said connector (4) is painted.

12. The connection of claim 1 wherein:

a. said first pin (13) is fixedly attached to said first side attachment member (8) and said first pin opening (12) is in said cap (5).

13. The connection of claim 12 wherein:

a. said cap (5) additionally comprises a substantially planar top attachment portion (21) that interfaces with said supported structural member (3).

14. The connection of claim 13 wherein:

a. said cap (5) additionally comprises a second substantially planar side attachment portion (22) that interfaces with said supported structural member (3).

15. The connection of claim 14 wherein:

a. said first side attachment member (8) additionally comprise an edge (37) on said substantially planar attachment portion (9) and said connection portion (10) of said first side attachment member (8) is attached to said edge (37).

16. The connection of claim 15 wherein:

a. said substantially planar side attachment portion (9) of said first side attachment member (8) additionally comprises fastener openings (55); and b. said connection (1) additionally comprises fasteners (57) that pass through said fastener openings (55) in said first substantially planar side attachment portion (9) of said first side attachment member (8) and into said supporting structural member (2).

17. The connection of claim 16 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

18. The connection of claim 17 wherein:

a. said fasteners (57) that that pass through said fastener openings (55) in said first substantially planar side attachment portion (9) of said first side attachment member (8) are masonry screw anchors (57); and b. said fasteners (58) that pass through said fastener openings (56) in said first and second substantially planar side attachment portions (6) and (22) of said cap (5) are self-drilling wood screws (58).

19. The connection of claim 18 wherein:

a. said first end (16) of said first pin (13) is welded to said first side attachment member (8).

20. The connection of claim 19 wherein:

a. said connection portion (10) of said first side attachment member (8) is welded to said edge (37).

21. The connection of claim 20 wherein:

a. said connector (4) is painted.

22. The connection of claim 1 wherein:

a. said cap (5), additionally comprises a second substantially planar side attachment portion (22) that interfaces with said supported structural member (3); and b. said connector (4) additionally comprises:

i. a second side attachment member (26) comprising a substantially planar attachment portion (9) lying in a first plane and a connection portion (10) comprising a plate attached to the planar attachment portion (9), lying in a second plane, wherein the second plane is not in the same plane as the first plane, the attachment portion (9) interfaces with and is fastened to one of said two sides (51) of said supporting structural member (2) and the connection portion (10) is positioned alongside said second substantially planar side attachment portion (22) of said cap (5); and ii. a second pin connection (29) that enables rotation between said second side attachment member (26) and said cap (5), wherein:

(1) said second substantially planar side attachment portion (22) interfaces with said supported structural member (3) opposite said first substantially planar side attachment portion (6); and wherein:

(2) said second pin connection (29) further comprises a second pin opening (12) in one of said cap (5) and said second attachment member (26), and a second pin (13) that passes through said second pin opening (12);

(3) said second pin (13) comprises a body (14) having a circumference (15), a first end (16), and a second end (17) said second end (17) of said second pin (13) is formed with a first restraint extension (18) that extends beyond said circumference (15) of said body (14);

(4) said second pin opening (12) has a circumference (19); and (5) said first restraint extension (18) is one or more lobes (18) that extend beyond said circumference of said second pin opening (12), preventing said second pin (13) from withdrawing from said second pin opening (12); said second pin opening (12) has one or more open lobes (20) that extend beyond said circumference (19) of said second pin opening (12); and said second pin (13) is inserted through said second pin opening (12) in an orientation that permits said one or more lobes (18) on said second pin (13) to pass through said one or more open lobes (20) of said second pin opening (12), and said cap (5) and said second side attachment member (26) are then rotated on said second pin connection (29) so that said one or more lobes (18) on said second pin (13) no longer match said one or more open lobes (20) of said second pin opening (12), thereby restraining said cap (5) and said second side attachment member (26) from being separated at said second pin connection (11); and (6) said second pin (13) is fixedly attached to the other of said cap (5) and said second side attachment member (26) that does not have a second pin opening (12) so that said first pin (13) cannot rotate within or withdraw from the other of said cap (5) and said second side attachment member (26) that does not have said second pin opening (12).

23. The connection of claim 22 wherein:

a. said first pin (13) is fixedly attached to said cap (5) and said first pin opening (12) is in said first side attachment member (8); and b. said second pin (13) is fixedly attached to said cap (5) and said second pin opening (12) is in said second side attachment member (26).

24. The connection of claim 23 wherein:

a. said cap (5) additionally comprises a substantially planar top attachment portion (21) that interfaces with said supported structural member (3).

25. The connection of claim 24 wherein:

a. said second substantially planar side attachment portion (22) of said cap (5) is attached to said substantially planar top attachment portion (21).

26. The connection of claim 25 wherein:

a. said first side attachment member (8) additionally comprises an edge (37) on said substantially planar attachment portion (9) and said connection portion (10) of said first side attachment member (8) is attached to said edge (37);

b. said second side attachment member (26) additionally comprise an edge (37) on said substantially planar attachment portion (9) and said connection portion (10) of said second side attachment member (26) is attached to said edge (37).

27. The connection of claim 26 wherein:

a. said substantially planar side attachment portion (9) of said first side attachment member (8) and said substantially planar side attachment portion (9) of said second side attachment member (26) additionally comprise fastener openings (55);

b. said connection (1) additionally comprises fasteners (57) that pass through said fastener openings (55) in said first substantially planar side attachment portion (9) of said first side attachment member (8) and said substantially planar side attachment portion (9) of said second side attachment member (26) and into said supporting structural member (2).

28. The connection of claim 27 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

29. The connection of claim 28 wherein:

a. said fasteners (57) that that pass through said fastener openings (55) in said first substantially planar side attachment portion (9) of said first side attachment member (8) and said substantially planar side attachment portion (9) of said second side attachment member (26) are masonry screw anchors (57); and b. said fasteners (58) that pass through said fastener openings (56) in said first and second substantially planar side attachment portions (6) and (22) of said cap (5) are self-drilling wood screws (58).

30. The connection of claim 29 wherein:

a. said first end (16) of said first pin (13) is welded to said cap (5); and b. said first end (16) of said second pin (13) is welded to said cap (5).

31. The connection of claim 30 wherein:

a. said connection portion (10) of said first side attachment member (8) is welded to said edge (37); and b. said connection portion (10) of said second side attachment member (26) is welded to said edge (37).

32. The connection of claim 31 wherein:

a. said connector (4) is painted.

33. The connection of claim 22 wherein:

a. said first pin (13) is fixedly attached to said first side attachment member (8) and said first pin opening (12) is in said cap (5); and b. said second pin (13) is fixedly attached to said second side attachment member (26) and said second pin opening (12) is in said cap (5).

34. The connection of claim 33 wherein:

a. said cap (5) additionally comprises a substantially planar top attachment portion (21) that interfaces with said supported structural member (3).

35. The connection of claim 34 wherein:

a. said second substantially planar side attachment portion (22) of said cap (5) is attached to said substantially planar top attachment portion (21).

36. The connection of claim 35 wherein:

a. said first side attachment member (8) additionally comprises an edge (37) on said substantially planar attachment portion (9) and said connection portion (10) of said first side attachment member (8) is attached to said edge (37);

b. said second side attachment member (26) additionally comprise an edge (37) on said substantially planar attachment portion (9) and said connection portion (10) of said second side attachment member (26) is attached to said edge (37).

37. The connection of claim 36 wherein:

a. said substantially planar side attachment portion (9) of said first side attachment member (8) and said substantially planar side attachment portion (9) of said second side attachment member (26) additionally comprise fastener openings (55);

b. said connection (1) additionally comprises fasteners (57) that pass through said fastener openings (55) in said first substantially planar side attachment portion (9) of said first side attachment member (8) and said substantially planar side attachment portion (9) of said second side attachment member (26) and into said supporting structural member (2).

38. The connection of claim 37 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

39. The connection of claim 38 wherein:

a. said fasteners (57) that that pass through said fastener openings (55) in said first substantially planar side attachment portion (9) of said first side attachment member (8) and said substantially planar side attachment portion (9) of said second side attachment member (26) are masonry screw anchors (57); and b. said fasteners (58) that pass through said fastener openings (56) in said first and second substantially planar side attachment portions (6) and (22) of said cap (5) are self-drilling wood screws (58).

40. The connection of claim 39 wherein:

a. said first end (16) of said first pin (13) is welded to said first side attachment member (8); and b. said first end (16) of said second pin (13) is welded to said second side attachment member (26).

41. The connection of claim 40 wherein:

a. said connection portion (10) of said first side attachment member (8) is welded to said edge (37); and b. said connection portion (10) of said second side attachment member (26) is welded to said edge (37).

42. The connection of claim 41 wherein:

a. said connector (4) is painted.

43. The connection of claim 1 wherein:

a. said first pin opening (12) is in said cap (5);

b. said first attachment member (8) additionally comprises a second pin opening (12) and said first pin (13) passes through said second pin opening (12);

c. said first pin (13) additionally comprises a second restraint extension (18) that extends beyond said circumference (15) of said body (14);

d. said second pin opening (12) has a circumference (19);

e. said second restraint extension (18) extends beyond said circumference (19) of said second pin opening (12), preventing said first pin (13) from withdrawing from said second pin opening (12).

44. The connection of claim 43 wherein:

said second restraint extension (18) is a circumferential flange (18) that extends beyond said circumference (15) of said body (14) and said circumference (19) of said second pin opening (12).

45. The connection of claim 44 wherein:

a. said cap (5) additionally comprises a substantially planar top attachment portion (21) that interfaces with said supported structural member (3).

46. The connection of claim 45 wherein:

a. said cap (5) additionally comprises a second substantially planar side attachment portion (22) that interfaces with said supported structural member (3).

47. The connection of claim 46 wherein:

a. said connection portion (10) of said first side attachment member (8) additionally comprises a reinforcing embossment (25) around said first pin opening (12) in said first side attachment member (8).

48. The connection of claim 47 wherein:

a. said first substantially planar side attachment portion (6) of said cap (5) additionally comprises a reinforcing embossment (25) around said second pin opening (12) that matches said reinforcing embossment (25) around said first pin opening (12) in said first side attachment member (8) so that said reinforcing embossment (25) and said reinforcing embossment (25) fit together and transmit bearing forces between said cap (5) and said first side attachment member (8).

49. The connection of claim 48 wherein:

a. said substantially planar attachment portion (9) of said first side attachment member (8) additionally comprises a reinforcing flange (23).

50. The connection of claim 49 wherein:

a. said connection portion (10) of said first side attachment member (8) additionally comprises a reinforcing flange (24).

51. The connection of claim 50 wherein:

a. said first pin (13) is a rivet.

52. The connection of claim 51 wherein:

a. said substantially planar side attachment portion (9) of said first side attachment member (8) additionally comprises fastener openings (55); and b. said connection (1) additionally comprises fasteners (57) that pass through said fastener openings (55) in said first substantially planar side attachment portion (9) of said first side attachment member (8) and into said supporting structural member (2).

53. The connection of claim 52 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

54. The connection of claim 53 wherein:

a. said fasteners (57) that that pass through said fastener openings (55) in said first substantially planar side attachment portion (9) of said first side attachment member (8) are masonry screw anchors (57); and b. said fasteners (58) that pass through said fastener openings (56) in said first and second substantially planar side attachment portions (6) and (22) of said cap (5) are self-drilling wood screws (58).

55. The connection of claim 43 wherein:

a. said cap member (5) additionally comprises a second substantially planar side attachment portion (22) that interfaces with the supported structural member (3); and b. said connector (4) additionally comprises:

i. a second side attachment member (26) comprising a substantially planar attachment portion (9) lying in a first plane and a connection portion (10) comprising a plate attached to the planar attachment portion (9), lying in a second plane, wherein the second plane is not in the same plane as the first plane, the attachment portion (9) interfaces with and is fastened to said supporting structural member (2), and the connection portion (10) is positioned alongside said second substantially planar side attachment portion (22) of said cap (5); and ii. a second pin connection (29) that enables rotation between said second side attachment member (26) and said cap (5), wherein:

(1) said second pin connection (29) further comprises a third pin opening (12) in said cap (5) and a fourth pin opening (12) in said second side attachment member (26), and a second pin (13) that passes through said third pin opening (12) and said fourth pin opening (12);

(2) said second pin (13) comprises a body (14) having a circumference (15), a first end (16) with a second restraint extension (18) that extend beyond said circumference (19), And a second end (17) with a first restraint extension (18) that extends beyond said circumference (15) of said body (14);

(3) said third pin opening (12) has a circumference (19) and said fourth pin opening (12) has a circumference (19); and (4) said first restraint extension (18) of said second pin (13) extends beyond said circumference (19) of said third pin opening (12), preventing said second pin (13) from withdrawing from said third pin opening (12); and (5) said second restraint extension (18) of said second pin (13) extends beyond said circumference (19) of said fourth pin opening (12), preventing said second pin (13) from withdrawing from said fourth pin opening (12).

56. The connection of claim 55 wherein:

said second restraint extension (18) of said first pin (13) is a circumferential flange (18) that extends beyond said circumference (15) of said body (14).

57. The connection of claim 56 wherein:

a. said cap (5) additionally comprises a substantially planar top attachment portion (21) that interfaces with said supported structural member (3).

58. The connection of claim 57 wherein:

a. said second substantially planar side attachment portion (22) of said cap (5) is attached to said substantially planar top attachment portion (21).

59. The connection of claim 58 wherein:

a. said connection portion (10) of said first side attachment member (8) additionally comprises a reinforcing embossment (25) around said second pin opening (12) in said first side attachment member (8); and b. said connection portion (10) of said second side attachment member (9) additionally comprises a reinforcing embossment (25) around said fourth pin opening (12) in said second side attachment member (9).

60. The connection of claim 59 wherein:

a. said first substantially planar side attachment portion (6) of said cap (5) additionally comprises a reinforcing embossment (25) around said first pin opening (12) that matches said reinforcing embossment (25) around said second pin opening (12) in said first side attachment member (8) so that said reinforcing embossment (25) in said first substantially planar side attachment portion (6) and said reinforcing embossment (25) fit together and transmit bearing forces between said cap (5) and said first side attachment member (8); and b. said second substantially planar side attachment portion (22) of said cap (5) additionally comprises a reinforcing embossment (25) around said third pin opening (12) that matches said reinforcing embossment (25) around said fourth pin opening (12) in said second side attachment member (26) so that said reinforcing embossment (25) in said second substantially planar side attachment portion (22) and said reinforcing embossment (25) in said second side attachment member (26) fit together and transmit bearing forces between said cap (5) and said second side attachment member (26).

61. The connection of claim 60 wherein:

a. said substantially planar attachment portion (9) of said first side attachment member (8) additionally comprises a reinforcing flange (23); and b. said substantially planar attachment portion (9) of said second side attachment member (26) additionally comprises a reinforcing flange (23).

62. The connection of claim 61 wherein:

a. said connection portion (10) of said first side attachment member (8) additionally comprises a reinforcing flange (24); and b. said connection portion (10) of said second side attachment member (9) additionally comprises a reinforcing flange (24).

63. The connection of claim 62 wherein:

a. said first pin (13) is a rivet; and b. said second pin (13) is a rivet.

64. The connection of claim 63 wherein:

a. said substantially planar side attachment portion (9) of said first side attachment member (8) and said substantially planar side attachment portion (9) of said second side attachment member (26) additionally comprise fastener openings (55);

b. said connection (1) additionally comprises fasteners (57) that pass through said fastener openings (55) in said first substantially planar side attachment portion (9) of said first side attachment member (8) and said substantially planar side attachment portion (9) of said second side attachment member (26) and into said supporting structural member (2).

65. The connection of claim 64 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

66. The connection of claim 65 wherein:

a. said fasteners (57) that that pass through said fastener openings (55) in said first substantially planar side attachment portion (9) of said first side attachment member (8) and said substantially planar side attachment portion (9) of said second side attachment member (26) are masonry screw anchors (57); and b. said fasteners (58) that pass through said fastener openings (56) in said first and second substantially planar side attachment portions (6) and (22) of said cap (5) are self-drilling wood screws (58).

67. The connection of claim 44 wherein:

a. said first side attachment member (8) is formed by bending a V-shaped length of steel in half to form a two-ply substantially planar attachment portion (9) and the connection portion (10) that joins the plies.

68. The connection of claim 67 wherein:

a. said substantially planar side attachment portion (9) of said first side attachment member (8) additionally comprises fastener openings (55); and b. said connection (1) additionally comprises fasteners (57) that pass through said fastener openings (55) in said first substantially planar side attachment portion (9) of said first side attachment member (8) and into said supporting structural member (2).

69. The connection of claim 68 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

70. The connection of claim 69 wherein:

a. said fasteners (57) that that pass through said fastener openings (55) in said first substantially planar side attachment portion (9) of said first side attachment member (8) are masonry screw anchors (57); and b. said fasteners (58) that pass through said fastener openings (56) in said first and second substantially planar side attachment portions (6) and (22) of said cap (5) are self-drilling wood screws (58).

71. The connection of claim 56 wherein:

a. said first side attachment member (8) is formed by bending a V-shaped length of steel in half to form a two-ply substantially planar attachment portion (9) and a connection portion (10) that joins the plies;

b. said second side attachment member (26) is formed by bending a V-shaped length of steel in half to form a two-ply substantially planar attachment portion (9) and a connection portion (10) that joins the plies.

72. The connection of claim 71 wherein:

a. said substantially planar side attachment portion (9) of said first side attachment member (8) and said substantially planar side attachment portion (9) of said second side attachment member (26) additionally comprise fastener openings (55);

b. said connection (1) additionally comprises fasteners (57) that pass through said fastener openings (55) in said first substantially planar side attachment portion (9) of said first side attachment member (8) and said substantially planar side attachment portion (9) of said second side attachment member (26) and into said supporting structural member (2).

73. The connection of claim 72 wherein:

a. said first and second substantially planar side attachment portions (6) and (22) of said cap (5) additionally comprise fastener openings (56); and b. said connection (1) additionally comprises fasteners (58) that pass through said fastener openings (56) in said first and second substantially planar side attachment portions (6) and (22) of said cap (5) and into said supported structural member (3).

74. The connection of claim 73 wherein:

a. said fasteners (57) that that pass through said fastener openings (55) in said first substantially planar side attachment portion (9) of said first side attachment member (8) and said substantially planar side attachment portion (9) of said second side attachment member (26) are masonry screw anchors (57); and b. said fasteners (58) that pass through said fastener openings (56) in said first and second substantially planar side attachment portions (6) and (22) of said cap (5) are self-drilling wood screws (58).

75. The connector of claim 1 in a connection wherein:

a. said supporting structural member is a wall; and b. said supported structural member is a beam (3).

76. The connector of claim 1 in a connection wherein:

a. said supporting structural member is a wall; and b. said supported structural member is a girder (3).

77. The connector of claim 1 in a connection wherein:

a. said supporting structural member is a wall; and b. said supported structural member is a truss (3).

78. The connection of claim 75 wherein:

a. said beam is a top chord of a truss (3).

79. The connection of claim 75 wherein:

a. said beam is a rafter (3).

80. The connector of claim 77 in a connection wherein:

a. said truss is a girder truss (3).

* * * * *